US008453481B2

(12) United States Patent
Meekma

(10) Patent No.: US 8,453,481 B2
(45) Date of Patent: Jun. 4, 2013

(54) PADLOCK

(75) Inventor: Glenn P. Meekma, Menomonee Falls, WI (US)

(73) Assignee: Master Lock Company LLC, Oak Creek, WI (US)

( * ) Notice: Subject to any disclaimer, the term of this patent is extended or adjusted under 35 U.S.C. 154(b) by 109 days.

(21) Appl. No.: 13/183,573

(22) Filed: Jul. 15, 2011

(65) Prior Publication Data

US 2012/0011902 A1 Jan. 19, 2012

Related U.S. Application Data

(60) Provisional application No. 61/364,501, filed on Jul. 15, 2010.

(51) Int. Cl.
*E05B 67/22* (2006.01)

(52) U.S. Cl.
USPC ..... 70/38 A; 70/25; 70/278.1

(58) Field of Classification Search
USPC ..... 70/21, 25, 38 A, 278.1–278.7, 52, 70/279.1
See application file for complete search history.

(56) References Cited

U.S. PATENT DOCUMENTS

| | | | |
|---|---|---|---|
| 656,672 | A | 8/1900 | Spencer |
| 1,140,919 | A | 5/1915 | Shipman |
| 1,310,634 | A | 7/1919 | Rozycki |
| 1,331,933 | A | 2/1920 | Kodish |
| 1,463,230 | A | 7/1923 | Squires |
| 1,607,758 | A | 11/1926 | Junkunc |
| 1,703,193 | A | 2/1929 | Jacobi |
| 1,719,637 | A | 7/1929 | Werner |
| 1,743,331 | A | 1/1930 | Ellison |
| 2,116,965 | A | 5/1938 | Schoorel et al. |
| 2,132,201 | A | 10/1938 | Allman |
| 2,160,294 | A | 5/1939 | Soref |
| 2,673,457 | A | 3/1954 | Miller |
| 2,691,288 | A | 10/1954 | Childs |
| 2,775,112 | A | 12/1956 | Taylor |
| 2,780,087 | A | 2/1957 | Miller |

(Continued)

FOREIGN PATENT DOCUMENTS

| | | |
|---|---|---|
| CN | 1482328 | 3/2004 |
| CN | 2625517 | 7/2004 |

(Continued)

OTHER PUBLICATIONS

International Search Report and Written Opinion for International Application No. PCT/US2001/044129, mailed Dec. 13, 2011.

*Primary Examiner* — Suzanne Barrett
(74) *Attorney, Agent, or Firm* — Calfee, Halter & Griswold LLP

(57) ABSTRACT

An electromechanical lock includes a lock body and a locking mechanism disposed in the lock body. The locking mechanism includes a blocker, first and second cams, and a motor. The blocker is movable between a locked position and an unlocked position. The first cam is rotatable about a first axis between a blocker obstructing position and a blocker clearance position. The second cam is rotatable about a second axis, spaced apart from the first axis, to move the first cam between the blocker obstructing position and the blocker clearance position. The motor is coupled to the second cam to rotate the second cam in response to an electrical authorization signal supplied to the motor.

20 Claims, 20 Drawing Sheets

U.S. PATENT DOCUMENTS 2,830,447 A 4/1958 Miller
2,852,928 A 9/1958 Miller
2,931,204 A 4/1960 Check
3,477,261 A 11/1969 Siana
3,720,083 A 3/1973 Wellekens
3,742,739 A 7/1973 Hickman
3,797,004 A 3/1974 Muessel et al.
3,831,065 A 8/1974 Martin et al.
3,835,675 A 9/1974 Lippisch
3,901,057 A 8/1975 Coley, Sr.
3,979,931 A 9/1976 Man
4,070,882 A 1/1978 Ruiz
4,220,022 A 9/1980 Willach
4,236,394 A 12/1980 Harrington et al.
4,476,698 A 10/1984 Treslo
4,556,872 A 12/1985 Masoncup et al.
4,581,652 A 4/1986 Kinoshita et al.
4,609,780 A 9/1986 Clark
4,655,368 A 4/1987 Bateman et al.
4,726,206 A 2/1988 Hsu
4,754,626 A 7/1988 Siegel
4,766,746 A 8/1988 Henderson et al.
4,802,210 A 1/1989 Spencer et al.
4,808,993 A 2/1989 Clark
4,829,795 A 5/1989 Taylor
4,838,052 A 6/1989 Williams et al.
4,851,652 A 7/1989 Imran
4,893,248 A 1/1990 Pitts et al.
4,896,370 A 1/1990 Kasparian et al.
4,929,880 A 5/1990 Henderson et al.
5,022,175 A 6/1991 Oncke et al.
5,033,282 A 7/1991 Gartner et al.
5,042,277 A 8/1991 Jenn-Rong
5,090,222 A 2/1992 Imran
5,156,028 A 10/1992 Jiang
5,181,403 A 1/1993 Lii
5,184,491 A 2/1993 Schittenhelm
5,195,342 A 3/1993 Werner
5,270,681 A 12/1993 Jack
5,280,518 A 1/1994 Danler et al.
5,345,794 A 9/1994 Jenks
5,372,019 A 12/1994 Hsiao
5,392,552 A 2/1995 McCarthy et al.
5,404,735 A 4/1995 Hsieh
5,417,000 A 5/1995 Chen
5,419,068 A 5/1995 Pages et al.
5,475,996 A 12/1995 Chen
5,488,338 A 1/1996 Seymour et al.
5,495,093 A 2/1996 Griffith
5,506,393 A 4/1996 Ziarno
5,507,161 A 4/1996 Broekaert et al.
5,522,243 A 6/1996 Kusmiss
5,550,529 A 8/1996 Burge
5,552,777 A 9/1996 Gokcebay et al.
5,561,935 A 10/1996 McCarthy et al.
5,561,996 A 10/1996 Chang
5,573,412 A 11/1996 Anthony
5,585,866 A 12/1996 Miller et al.
5,587,702 A 12/1996 Chadfield
5,589,058 A 12/1996 Bauer
5,589,892 A 12/1996 Knee et al.
5,590,191 A 12/1996 Guevara
5,598,725 A 2/1997 Chang
5,601,440 A 2/1997 Richter
5,605,066 A 2/1997 Hurskainen
5,612,668 A 3/1997 Scott
5,621,996 A 4/1997 Mowl, Jr.
5,629,733 A 5/1997 Youman et al.
5,727,405 A 3/1998 Cromwell
5,791,172 A 8/1998 Deighton et al.
5,798,701 A 8/1998 Bernal et al.
5,815,557 A 9/1998 Larson
5,821,866 A 10/1998 Bernal et al.
5,831,537 A 11/1998 Marman
D402,636 S 12/1998 Taft
5,844,458 A 12/1998 Bartholomew et al.
5,868,013 A 2/1999 Julien
D411,949 S 7/1999 Hill
5,927,112 A 7/1999 Yamashita
5,936,553 A 8/1999 Kabel
5,953,940 A 9/1999 Ling
5,999,095 A 12/1999 Earl et al.
6,011,469 A 1/2000 Taft et al.
6,046,558 A 4/2000 Larson et al.
6,047,575 A 4/2000 Larson et al.
6,064,430 A 5/2000 Lefkowitz
D426,250 S 6/2000 Lefkowitz
6,072,402 A 6/2000 Kniffin et al.
6,079,241 A 6/2000 Burleigh et al.
D427,884 S 7/2000 Castellanos et al.
6,249,310 B1 6/2001 Lefkowitz
6,396,438 B1 5/2002 Seal
6,401,501 B1 6/2002 Kajuch et al.
6,425,274 B1 7/2002 Laitala et al.
6,442,983 B1 9/2002 Thomas et al.
6,517,127 B1 2/2003 Lu et al.
D471,429 S 3/2003 Williams et al.
6,585,302 B2 7/2003 Lin
6,591,643 B1 7/2003 Cannella et al.
6,598,439 B1 7/2003 Chen
6,598,909 B2 7/2003 Lu
6,718,803 B2 4/2004 Knoll
6,761,051 B1 7/2004 Tsai
6,792,779 B1 9/2004 Shen
6,807,834 B2 10/2004 Tsai
6,832,500 B1 12/2004 Chen
6,898,952 B1 5/2005 Lin
6,993,943 B1 2/2006 Chang
7,117,698 B2 10/2006 Lai
7,251,965 B2 8/2007 Yu
7,316,141 B2 1/2008 Goldman
D567,628 S 4/2008 Rohde et al.
7,423,515 B1 * 9/2008 Fiske et al. ..... 340/5.2
D594,311 S 6/2009 Stevens
D594,731 S 6/2009 Plato
7,562,545 B2 7/2009 Lai et al.
7,571,627 B2 8/2009 Yu
D605,494 S 12/2009 Plato
D629,280 S 12/2010 Plato
D637,062 S 5/2011 Plato
7,934,405 B2 5/2011 Burmesch et al.
7,948,359 B2 * 5/2011 Marcelle et al. ..... 340/5.64
8,225,629 B2 * 7/2012 Zuraski et al. ..... 70/21
2002/0046584 A1 4/2002 Lumpkin et al.
2003/0196461 A1 10/2003 Liou
2004/0093914 A1 5/2004 Vito
2005/0156441 A1 7/2005 Tsai
2006/0283216 A1 12/2006 Marcelle et al.
2007/0220929 A1 9/2007 Green
2008/0173049 A1 7/2008 Burmesch et al.
2008/0314093 A1 12/2008 Nave
2009/0113947 A1 5/2009 Lai et al.
2009/0145178 A1 6/2009 Nave et al.
2009/0282876 A1 11/2009 Zuraski et al.
2009/0320537 A1 12/2009 Alexander
2010/0083713 A1 4/2010 Woodling
2010/0095718 A1 4/2010 Lai et al.

FOREIGN PATENT DOCUMENTS

CN 2675799 2/2005
CN 2675802 2/2005
CN 2680791 2/2005
DE 202004002706 5/2004
DE 202004003813 5/2004
DE 100 56 119 B4 12/2005
GB 1531951 11/1978
GB 2122283 1/1984
GB 2229220 9/1990
TW 0220911 8/1991
TW 0220910 3/1992
TW 022482 9/1992
TW 0220912 4/1994
TW 553286 9/2003
WO 89/11577 11/1989
WO 90/15910 12/1990

* cited by examiner

PADLOCK

CROSS-REFERENCE TO RELATED APPLICATIONS

This application claims priority to, and any other benefit of, U.S. Provisional patent application Ser. No. 61/364,501, entitled DEADLOCKING PADLOCK and filed Jul. 15, 2010, the entire disclosure of which is fully incorporated herein by reference.

BACKGROUND

Security devices, such as padlocks and other types of conventional locks, are used, for example, to prevent access to a room, building, enclosure, container, or piece of equipment. Exemplary padlocks include those opened by a key and those opened by manipulation of lock components in accordance with a unique combination. In a conventional padlock, a shackle is secured within a lock body by one or more internal locking members that are received in corresponding notches in the shackle to prevent axial withdrawal of the shackle from the lock body. Certain conventional padlocks of this type may be susceptible to unauthorized opening by manipulation of the locking members using a lock-picking tool or other instrument inserted into the lock body (e.g., through the shackle holes) to disengage the locking members from the shackle notches.

SUMMARY

The present application describes locking arrangements for securing a lock, such as, for example, a padlock, in a locked condition against unauthorized attempts to unlock or open the lock. According to one exemplary aspect of the present application, a lock may include a locking mechanism having a blocker moveable between locked and unlocked positions, and one or more components that allow movement of the blocker to the unlocked position upon proper manipulation of the lock, and that secure the blocker against unauthorized movement to the unlocked position.

Accordingly, in an exemplary embodiment, a padlock includes a lock body, a shackle, and a locking mechanism. The shackle includes long and short legs receivable in corresponding first and second shackle openings in the lock body. The shackle is axially moveable between a refracted position and an extended position, with the short leg being withdrawn from the lock body in the extended position. The locking mechanism is disposed in the lock body and includes a locking member and a blocker axially movable with respect to the lock body. The blocker includes a blocking surface configured to hold the locking member in locking engagement with the shackle when the blocker is in a shackle engaging position, and to allow the locking member to disengage from the shackle when the blocker is in a shackle disengaging position, to permit movement of the shackle from the retracted position to the extended position. The locking mechanism further includes a latch member movable between a blocker obstructing position and a blocker clearance position, and a driver operable in response to proper user manipulation of the lock to move the latch member from the blocker obstructing position to the blocker clearance position to permit movement of the blocker to the shackle disengaging position. The driver is inoperable prior to proper user manipulation of the lock.

In another exemplary embodiment, an electromechanical lock includes a lock body and a locking mechanism disposed in the lock body. The locking mechanism includes a blocker, first and second cams, and a motor. The blocker is movable between a locked position and an unlocked position. The first cam is rotatable about a first axis between a blocker obstructing position and a blocker clearance position. The second cam is rotatable about a second axis, spaced apart from the first axis, to move the first cam between the blocker obstructing position and the blocker clearance position. The motor is coupled to the second cam to rotate the second cam in response to an electrical authorization signal supplied to the motor.

In still another exemplary embodiment, an electromechanical padlock includes a lock body, a shackle, and a locking mechanism. The shackle includes long and short legs receivable in corresponding first and second shackle openings in the lock body. The shackle is axially moveable between a refracted position and an extended position, with the short leg being withdrawn from the lock body in the extended position. The locking mechanism is disposed in the lock body and includes a locking member and a blocker axially movable with respect to the lock body. The blocker includes a blocking surface configured to hold the locking member in locking engagement with the shackle when the blocker is in a shackle engaging position, and to allow the locking member to disengage from the shackle when the blocker is in a shackle disengaging position, to permit movement of the shackle from the retracted position to the extended position. The locking mechanism further includes an electromechanical driver operable in response to an electrical authorization signal supplied to the electromechanical driver to permit movement of the blocker to the shackle disengaging position. A battery is electrically connected with the electromechanical driver to power the electromechanical driver. A battery door is assembled with the lock body to limit access to the battery. The blocker further includes a battery door latch configured to secure the battery door in a closed position when the blocker is in the shackle engaging position, and to permit movement of the battery door to an open position when the blocker is in the shackle disengaging position.

BRIEF DESCRIPTION OF THE DRAWINGS

Further features and advantages of the invention will become apparent from the following detailed description made with reference to the accompanying drawings, wherein.

DETAILED DESCRIPTION

Figure 1C:
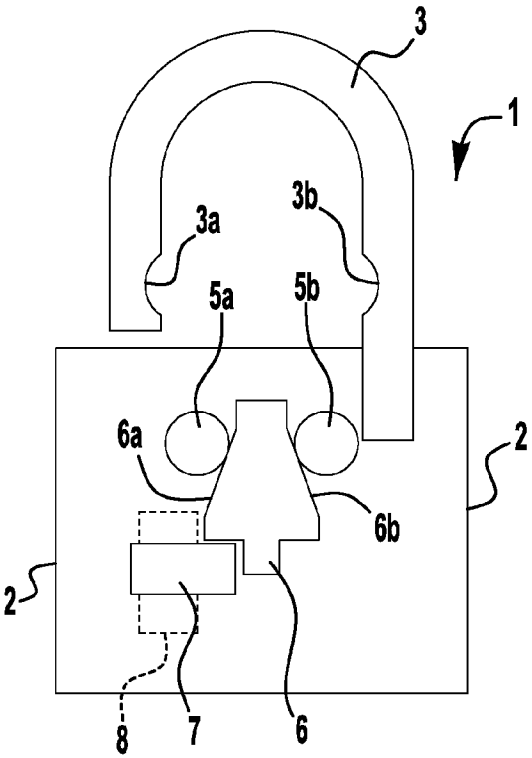
FIG. 1C is a front cross-sectional schematic view of the padlock of FIG. 1A shown in an opened condition.

This Detailed Description merely describes embodiments of the invention and is not intended to limit the scope of the claims in any way. Indeed, the invention as claimed is broader than and unlimited by the preferred embodiments, and the terms used in the claims have their full ordinary meaning.

Also, while the exemplary embodiments described in the specification and illustrated in the drawings relate to an electronic keypad pushbutton padlock, it should be understood that many of the inventive features described herein may be applied to other types of electronic padlocks, including, for example, remote operated (e.g., infrared, RFID, BLUETOOTH®, or other wireless communications) or biometric (e.g., fingerprint scan, voice recognition) padlocks, as well as other types of locking devices, including, for example, safes, lock boxes, cable locks, and locking bolts. Still other inventive features described herein may apply to purely mechanical locking mechanisms, including, for example, key operated or combination dial padlocks.

Figure 1B:
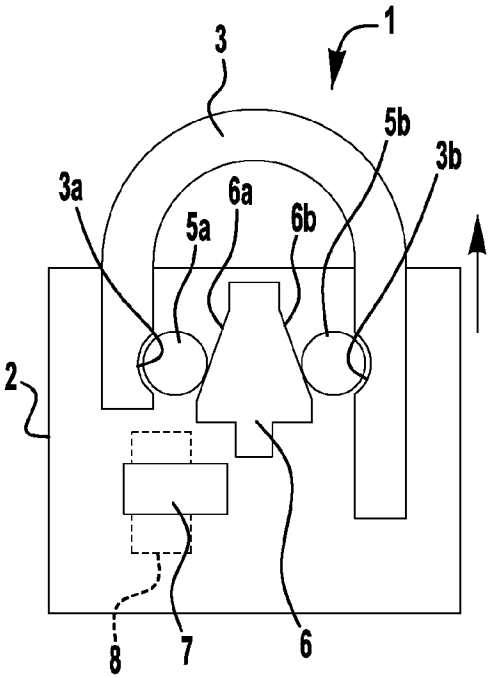
FIG. 1B is a front cross-sectional schematic view of the padlock of FIG. 1A, shown in an unlocked condition.
Figure 1A:
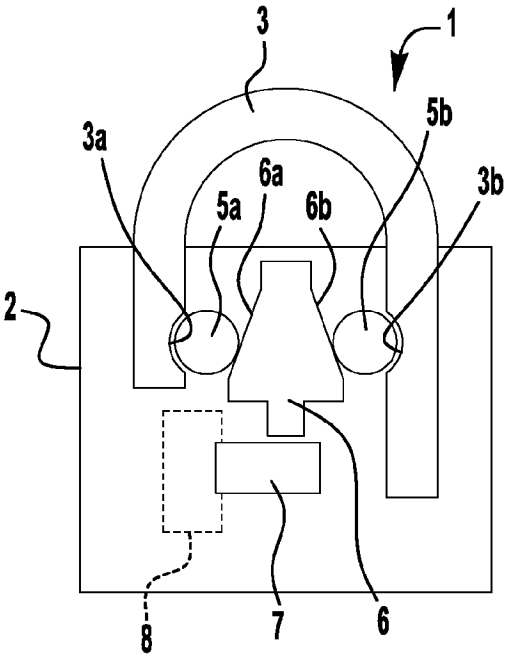
FIG. 1A is a front cross-sectional schematic view of an exemplary padlock shown in a locked condition.

The present application contemplates, in part, a locking mechanism for a lock (e.g., a padlock) that provides for secure locking of the padlock, to prevent picking, jamming, shimming or otherwise defeating of the padlock locking mechanism by directly or indirectly moving one or more locking members (e.g., locking balls or rollers) out of locking engagement with the padlock shackle. In one such exemplary padlock 1, as schematically shown in FIGS. 1A, 1B, and 1C, a blocker 6 disposed within the lock body 2 forces locking members 5*a*, 5*b* into locking engagement with notches 3*a*, 3*b* in the padlock shackle 3. In the locked condition, shown in FIG. 1A, a latch member 7 adjacent to an end portion 6' of the blocker 6 prevents movement of the blocker 6 to a shackle releasing position that permits disengagement of the locking members 5*a*, 5*b* from the shackle notches 3*a*, 3*b*. In the unlocked condition, shown in FIG. 1B, the latch member 7 is moved or is made movable by a driver (shown schematically at 8) to provide clearance for the blocker end portion 6' to permit movement of the blocker 6 to the shackle releasing position (shown in FIG. 1C).

Many different types of latch members may be utilized to obstruct movement of the blocker, including, for example, sliding, pivoting, and/or rotating latch components. In one embodiment, a latch member includes a rotatable cam having a cutout portion that aligns with the blocker end portion to permit movement of the blocker to the shackle releasing position. The invention is operable and may be used with any suitable type of latch member.

Many different types of drivers may be utilized to move (or make movable) a blocker in a padlock, including, for example, key-operated mechanical drivers (e.g., key cylinders), combination dial operated mechanical drivers (e.g., a wheel or cam), or electromechanical drivers (e.g., motors, solenoids, actuators). In one embodiment, an electromechanical driver includes a rotary motor configured to move a latch member to provide clearance for movement of a blocker to a shackle releasing position. While the latch member may be directly rotatable by the motor, such that the latch member rotates about the motor axis, in other embodiments, a driver may include a motor (or other mechanical device) and a linking member (e.g., a cam or gear), with the motor being be connected to the latch member by the linking member. Such an arrangement may provide deadlocking engagement between the driver and the latch member to prevent unauthorized forced movement of the latch member. For example, the linking member may provide for rotation of the latch member about an axis spaced apart from and/or non-parallel with the driver axis, or altered, non-rotational movement of the latch member, such as, for example, sliding or pivoting movement of the latch member. The invention is operable and may be used with any suitable type of driver.

An electromechanical driver may be operated by one or more of a variety of interfaces, including, for example, electronic keys and/or key cards, electronic keypads, remote transceivers, or biometric readers (e.g., fingerprint scanner). In one embodiment, an electronic keypad is configured to deliver an actuation signal to an electromechanical driver in response to pressing of one or more buttons of the keypad in a predetermined sequence.

FIGS. 2-13 illustrate an exemplary electronic padlock 10 having a lock body 20 and a shackle 30. The exemplary lock body 20 includes a back plate 25 secured to a main housing 27 by fasteners 29. The shackle 30 is assembled with the lock body for movement between a shackle engaged condition, in which both legs 31, 33 of the shackle 30 are received within the lock body 20, and a shackle disengaged condition, in which the short shackle leg 31 is disengaged or withdrawn from the lock body, to permit removal of the padlock 10 from a hasp, locker latch, or other external structure. As shown in FIGS. 4A-4C, the shackle 30 is secured in a locked condition by an internal locking mechanism 50 including an axially slidable blocker 60 with side blocking surfaces that force locking members 52, 54 laterally outward into notches 32, 34 in the shackle legs 31, 33 to secure the shackle 30 in an engaged condition. The blocker 60 includes an extension or post 65 that abuts against a latch cam 70 (or other such latch member) when the locking mechanism 50 is in the locked condition, thereby preventing axial movement of the blocker 60. When the exemplary latch cam 70 is rotated to an unlocked condition, a gap or cutout 75 in the latch cam 70 aligns with the post 65 to permit axial movement of the blocker 60. In this unlocked condition, when the shackle 30 is axially pulled in an opening or withdrawing direction, a laterally inward force is directed from the shackle notches 32, 34 through the locking members 52, 54 to tapered camming surfaces 62, 64 of the blocker 60. These laterally inward forces against the tapered camming surfaces 62, 64 move the blocker 60 axially downward against springs 55, such that the post 65 is received in the cutout 75. In this axially downward position, laterally inward forces on the locking members 52, 54 (from pulling on the shackle 30) push the locking members laterally inward against a necked down portion 66 of the blocker 60, and out of engagement with the shackle notches 32, 34, thereby allowing the shackle 30 to be withdrawn to a disengaged or open position. The long shackle leg 33 may be provided with a retaining clip 35 or other structure to prevent complete withdrawal of the shackle 30 from the lock body 20.

While the latch cam 70 may be directly driven, for example, by a solenoid, motor, key cylinder, or dial, in another embodiment, an independently movable driver may be provided to rotate the latch cam to an unlocked position upon proper manipulation of the lock, while securing the latch cam against rotation to the unlocked position when the padlock is locked. This arrangement provides a "deadlocking" feature, in which lock-picking tools or other instruments inserted into the lock body (e.g., through the shackle holes 22, 24) are prevented from moving the locking members, the blocker, or the latch cam. In the illustrated embodiment (see FIGS. 5A-5D), an exemplary rotatable driver cam 80 includes a contoured outer surface 87 that mates with a corresponding contoured surface 77 of the latch cam 70 to prevent rotational movement of the latch cam when the locking mechanism 50 is in a locked condition. While any suitable mating contoured surfaces may be utilized, in the illustrated embodiment, a cylindrical surface 87 of the driver cam 80 mates with a corresponding scalloped surface 77 of the latch cam 70 to prevent rotation of the latch cam while allowing rotation of the driver cam 80.

Figure 5A:
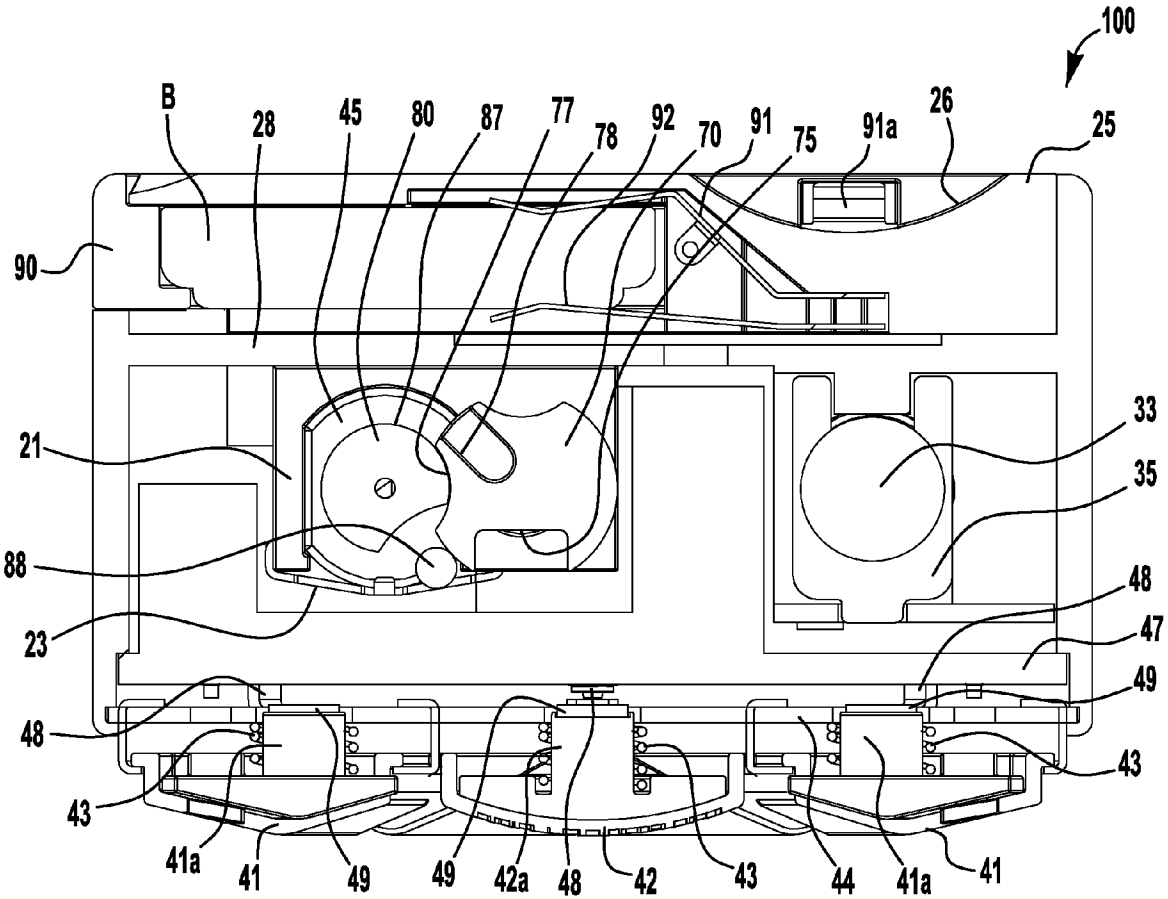
FIG. 5A is an upper cross-sectional view of the padlock of FIG. 2, shown with the driver and latch cam in the locked conditions.
Figure 5B:
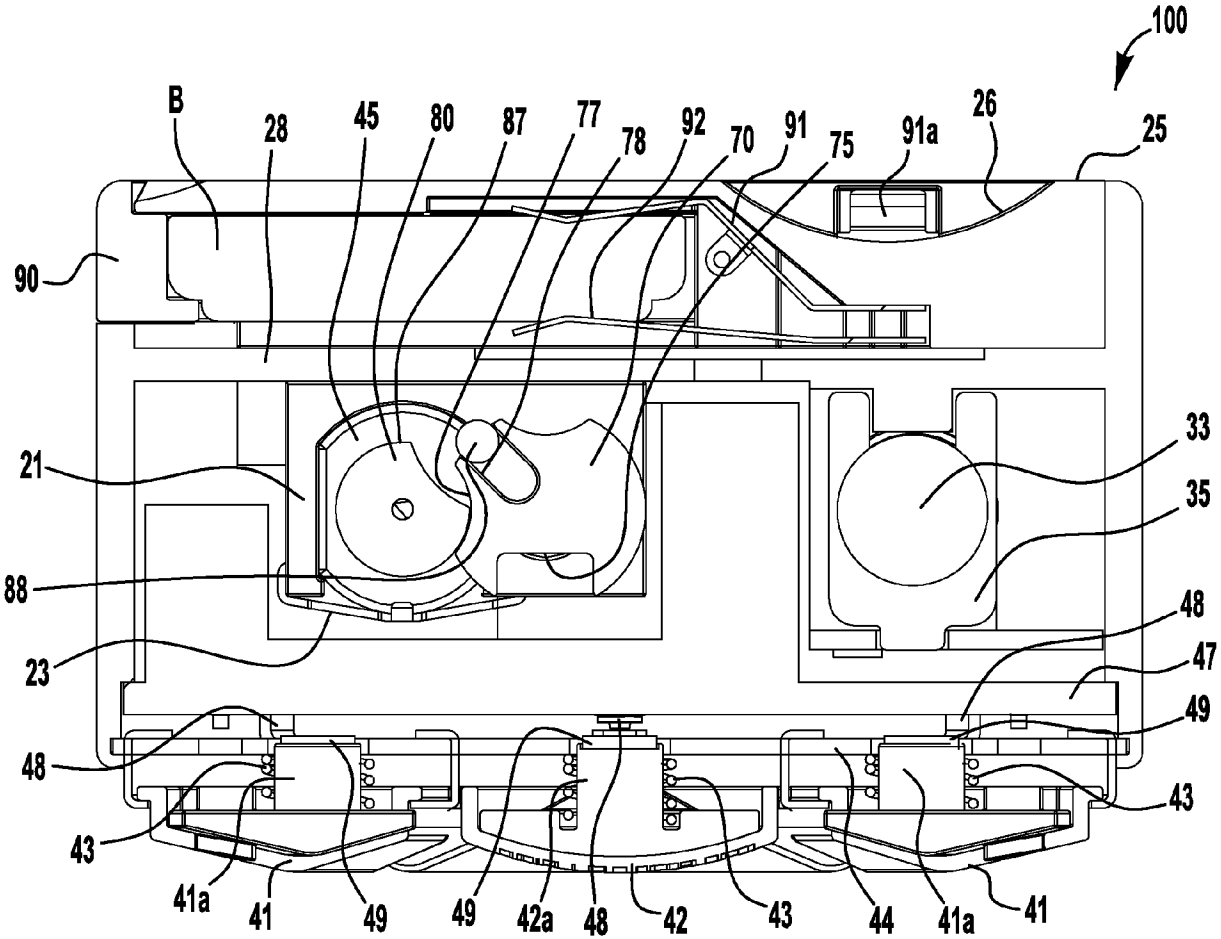
FIG. 5B is an upper cross-sectional view of the padlock of FIG. 2, shown with the driver in a latch cam engaging condition and the latch cam in the locked condition.
Figure 5C:
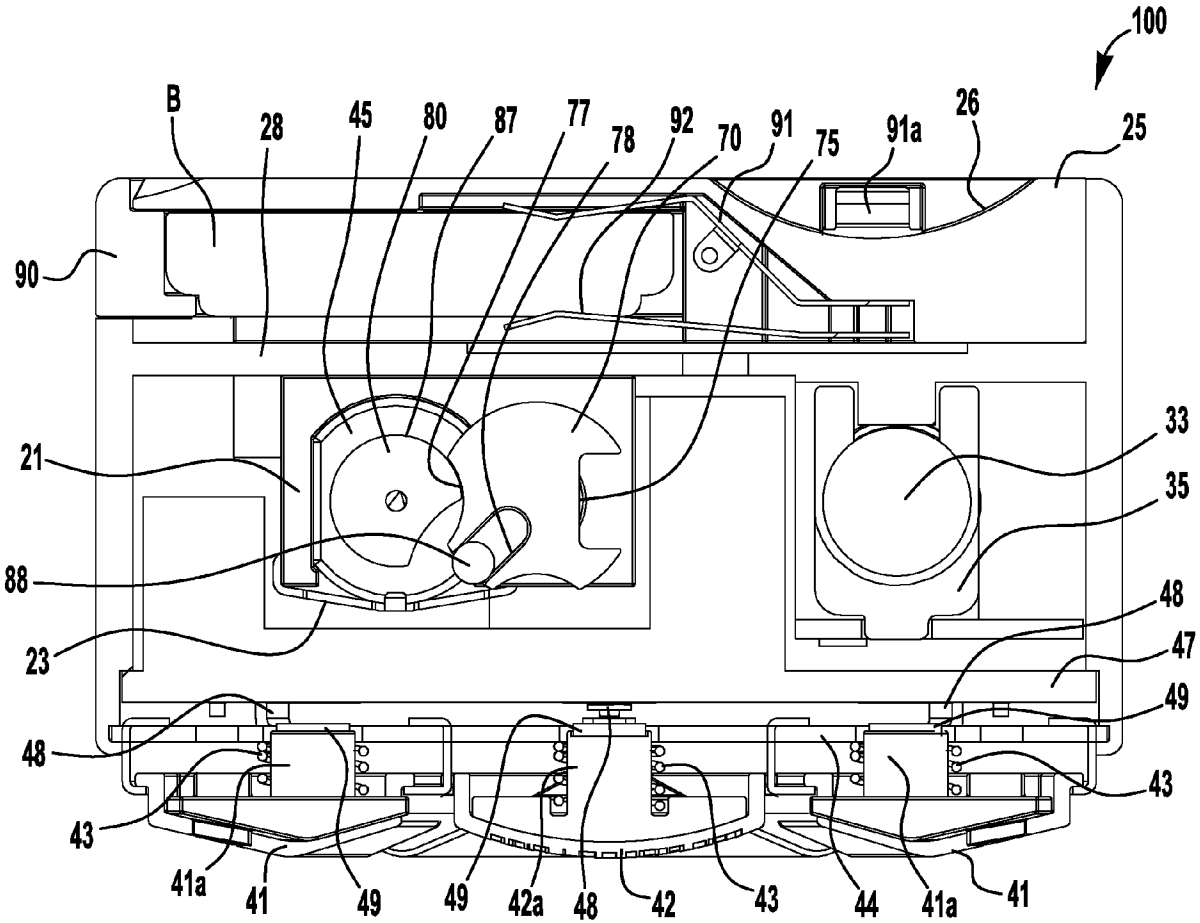
FIG. 5C is an upper cross-sectional view of the padlock of FIG. 2, shown with the driver in a latch cam engaging condition and the latch cam in the unlocked condition.
Figure 5D:
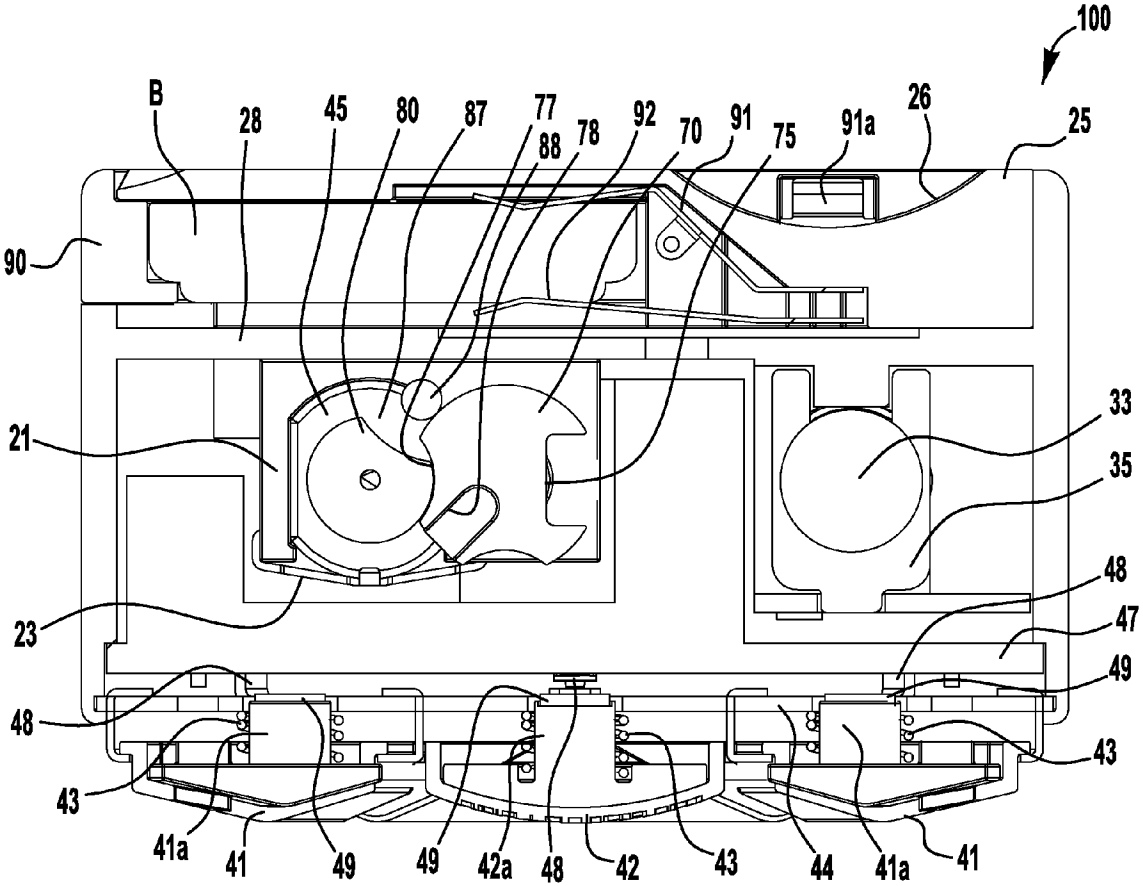
FIG. 5D is an upper cross-sectional view of the padlock of FIG. 2, shown with the driver and latch cam in the unlocked conditions.
Figure 6:
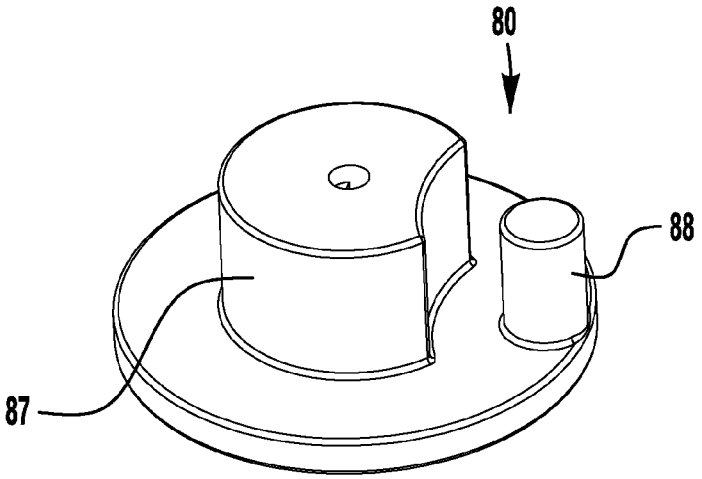
FIG. 6 is a lower perspective view of the driver of the padlock of FIG. 2.

When the driver cam 80 is rotated (e.g., by a key cylinder, combination dial, torsion spring, or motor, as described in greater detail below), a driving portion of the driver cam 80 engages a driven portion of the latch cam 70 to rotate the latch cam to an unlocked condition, to align the latch cam cutout 75 with the blocker post 65. While the rotational range of motion of the driver may be limited to an amount required to rotate the latch cam between locked and unlocked conditions (in one example, about 90°), in other embodiments, the driver may be configured to rotate over a substantially larger rotational range between rotational end positions of the driver. The illustrated embodiment uses a "Geneva Cam" type arrangement, in which the driver cam 80 is first rotated from a first latch cam deadlocking condition (FIG. 5A) to engage a pin 88 extending from the driver cam 80 within a slot 78 in the latch cam 70 (FIG. 5B). Subsequent further rotation of the driver cam 80 positions the latch cam 70 in the unlocked condition in which the latch cam cutout 75 is aligned with the blocker post 65 (FIG. 5C). Still further rotation of the driver cam 80 disengages the pin 88 from the slot 78 and positions the driver cam 80 in a second latch cam deadlocking condition, while maintaining the latch cam 70 in the unlocked condition (FIG. 5D). In an exemplary embodiment, during the unlocking operation, the driver cam 80 is rotated approximately 250° from the first latch cam deadlocking condition to the latch cam engaging condition, approximately 110° from the latch cam engaging condition to the latch cam unlocked condition (for 90° rotation of the latch cam from the locked condition to the unlocked condition), and approximately 250° from the latch cam unlocked condition to the second latch cam deadlocking condition, for a total of approximately 610° of rotation for the driver cam 80. By requiring extensive rotation (e.g., at least 270°, or at least 360°) of the driver cam 80 to rotate the latch cam 70 to the unlocked condition, unauthorized manipulation of the driver cam 80 (e.g., by lock-picking tools or other instruments) to an unlocking condition is effectively impeded. Other rotational ranges may additionally or alternatively be used to impede unauthorized manipulation of the locking mechanism.

A lock interface is provided such that the ability to operate the driver to unlock the padlock is restricted to one or more authorized users. Many different suitable mechanisms may be utilized to rotate the driver, including, for example, a manually rotatable key cylinder or combination dial, or an electrically operable solenoid or motor. In the illustrated embodiment, a motor 45 is assembled with the driver cam 80 to rotate the driver upon receipt of a electrical authorization signal at the motor 45, thereby aligning the latch cam cutout 75 with the blocker post 65. While any suitable motor may be used, in one embodiment, a standard pulse width modulated DC motor having a nominal voltage of 3 V and a torque rating of 2 m-Nm/A is used (e.g., PMDC motor model no. NFC03MG-012 from Johnson Motor). The exemplary motor 45 is secured within the lock body 20 by a motor clip 23 fastened to a motor mount 21, which rotationally supports the latch cam 70. When the post 65 is received in the cutout 75 during withdrawal of the shackle 30 (as described in greater detail above), interlocking engagement of the cutout 75 with the post 65 prevents return rotation of the latch cam 70 to the locked condition. When the shackle 30 is re-inserted into the lock body 20 and the shackle notches 32, 34 are aligned with the locking members 52, 54, the axial forces of the springs 55 on the blocker 60 force the locking members 52, 54 laterally outward into the notches 32, 34, allowing the blocker 60 to be forced upward to the locked condition (i.e., holding the locking members in engagement with the shackle notches).

Once the blocker 60 has returned to the locked condition, separation of the post 65 from the cutout 75 allows for rotation of the latch cam 70 back to the locked condition. Many mechanisms may be used to rotate the latch cam 70 back to the locked condition, including, for example, a torsion return spring, key cylinder, combination dial mechanism, or motor. In the illustrated embodiment, the motor 45 is bi-directional, such that the motor provides a reverse rotational output to rotate the driver cam 80, and in turn, the latch cam 70, back to the locked conditions. In the illustrated embodiment, a switch 46 is provided under the short shackle leg 31 (see FIG. 6). A standard detect switch may be used, such as, for example, a 2N detector switch type ESE22 from Panasonic. When the shackle 30 is re-engaged with or re-inserted into the lock body 20, the short shackle leg 31 actuates the switch 46 to prompt the motor 45 (through circuitry on PC board 47) to operate in the reverse or locking direction. The reverse operation of the motor 45 rotates the driver cam 80 back into engagement with the latch cam slot 78 (FIG. 5C), to a locked position of the latch cam 70 at which the pin 88 disengages from the slot 78 (FIG. 5B), and to a hard stop at the first latch cam deadlocking condition (FIG. 5A). The switch 46 may also serve additional functions. For example, completion of an entered authorization code (for example, by pressing a series of buttons on an electronic keypad connected with the PC board 47) may be communicated to the PC board by depressing the locked shackle 30 to engage the switch 46. This operation may also serve to remove any inadvertent load on the latch cam 70 by the blocker post 65 to facilitate reduced resistance in the motor-driven rotation of the driver cam 80 and latch cam 70. As shown, the shackle notches 32, 34 may be elongated to permit this vertical movement of the shackle 30.

To prevent an unlocked padlock 10 with engaged shackle 30 from inadvertently being left unlocked, the PC board 47 may be configured to signal the motor 45 to re-lock the lock after a predetermined amount of time (e.g., 1-2 minutes). If the shackle 30 is not withdrawn from the lock body 20, the motor 45 will rotate the driver cam 80 and latch cam 70 back to their locked conditions. If the shackle 30 is withdrawn from the lock body 20 to open the padlock 10, interlocking engagement between the blocker post 65 and the latch cam cutout 75 prevents reverse rotation and causes such motor operation to cease.

While many different electronic lock interfaces may be utilized to provide an electrical signal to the PC board 47 for operation of the motor 45, in the illustrated embodiment, the lock interface of the padlock 10 includes an electronic keypad 40 for entry of an authorized combination code to unlock the padlock. Many types of keypads may be utilized, including keypads with any number of buttons displaying identifying indicia 41*i*, such as numbers, letter, symbols, or colors. In the illustrated embodiment, the keypad 40 is limited to four directional buttons 41 and a center "reset" button 42. The PC board 47 may be configured to receive and evaluate electronic signals from the keypad 40 corresponding to any length sequence of key entries (e.g., three to twelve entries) for comparison of the entered code with one or more authorized codes stored in memory provided with the PC board 47. Upon identifying the entered combination code as corresponding to an authorized code, the PC board 47 delivers an electrical authorization signal to the motor 45 to rotate the driver cam 80 and latch cam 70 to the unlocked conditions. The reset button 42 may be configured to clear an incorrectly entered combination code sequence for entry of a new code sequence.

Key buttons (either the same buttons 41, 42 or additional buttons) may further be utilized to allow for modification of the authorized codes (e.g., changing, adding, or deleting authorized codes, or changing a master code, the entry of which is required to make code modifications). Many different types of visible or audible indicators (e.g., LED's or other light sources, sound emitting devices) may be connected with the PC board to provide user notification of correctly or incorrectly entered codes, cleared code entry, low battery power, or other conditions, and may be used, for example, to facilitate programming, re-programming, or monitoring of the lock. In the illustrated example, as shown in FIGS. 5A-5D, LED's 48 (e.g., blue chip LED model no. THB105-69 from Seoul Semiconductor) are disposed on the PC board 47 behind the at least partially translucent directional buttons 41 to provide positive indication that a button 41 has been depressed. A multicolored RGB chip LED (e.g., model no. LTST-C19GD2WT from Lite-On Technology Corp.) may be disposed behind the reset button 42 to provide multiple indications, such as, for example, correct code entry (e.g., green light), incorrect code entry (e.g., red light), and code reset (e.g., blue light).

Figure 2:
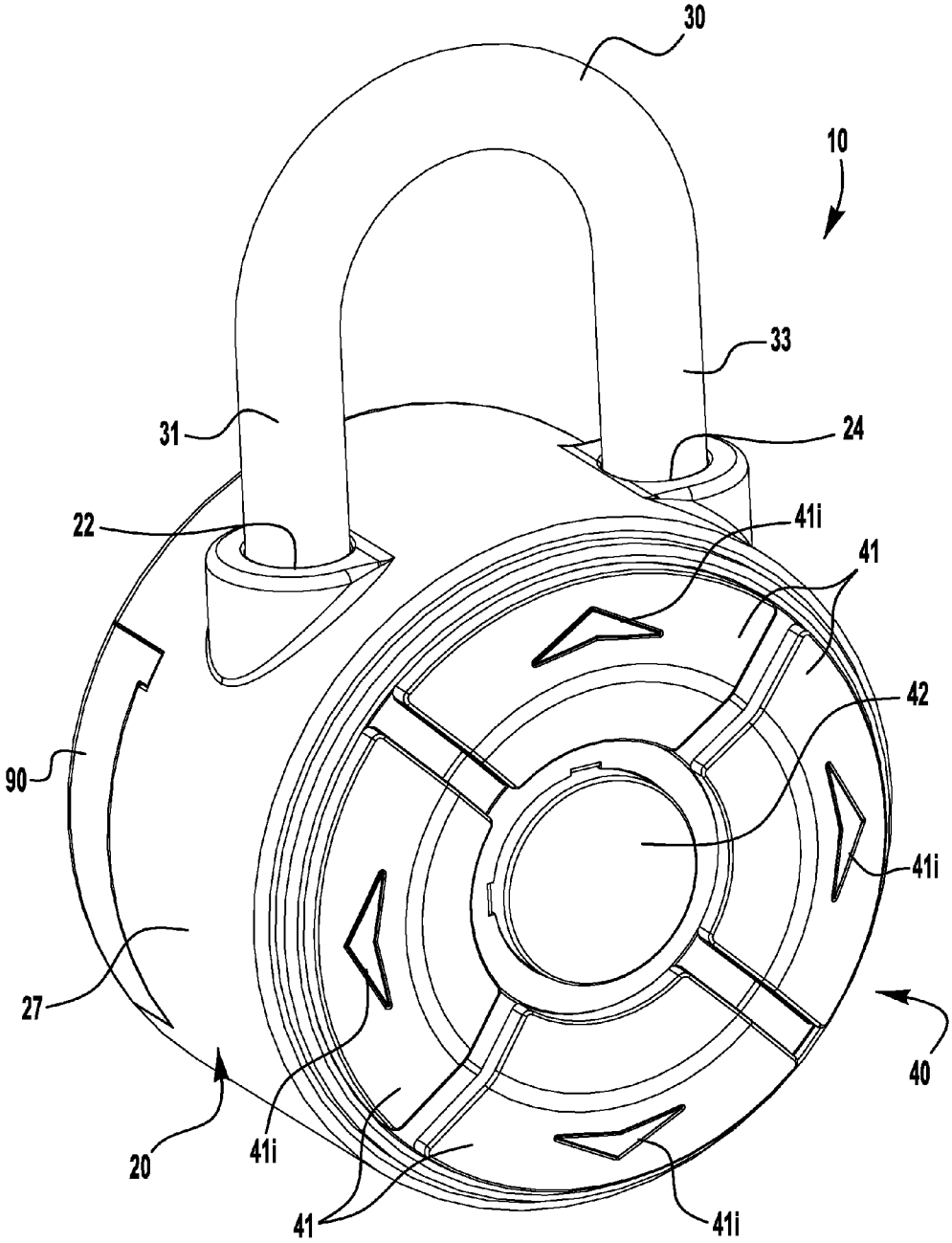
FIG. 2 is a front perspective view of an exemplary padlock.
Figure 2A:
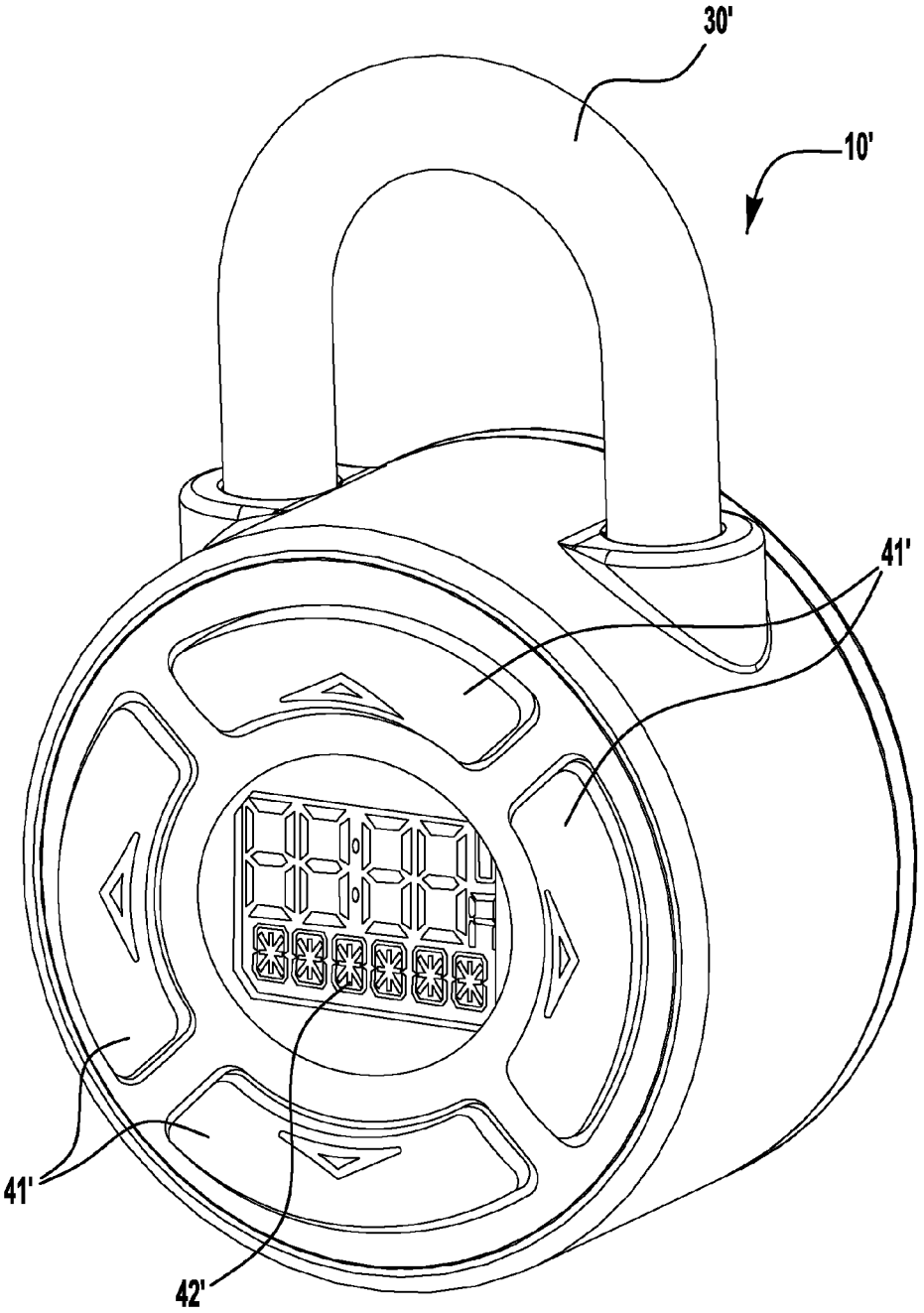
FIG. 2A is a front perspective view of another exemplary padlock.

In other embodiments, an electromechanical padlock may be provided with an electronic display (e.g., an LED or LCD display) to communication to the user one or more conditions, settings, or programming options for the lock. In one such exemplary embodiment, as shown in FIG. 2A, a padlock 10' includes an LED display panel 42' mounted between directional buttons 41' on a front face of the lock 10'. The display panel 42' may be configured to identify conditions, settings, and/or options to the user, for example, using brief multi-character or 1-2 word messages (e.g., "CLr USER," "CodE ENTER," Error RETRY"), thereby facilitating identification of a lock condition, or carrying out of a multi-step programming operation.

Figure 2B:
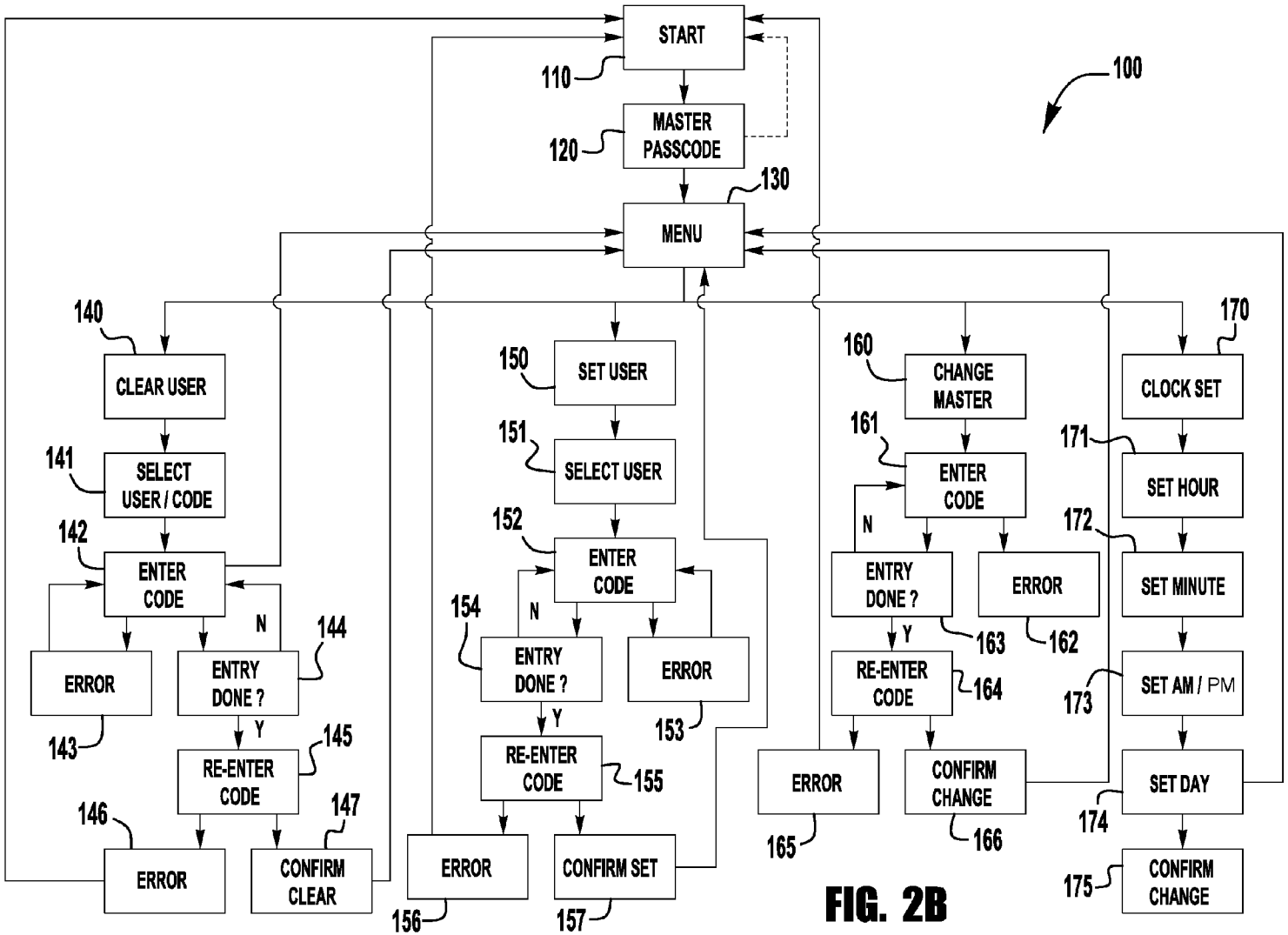
FIG. 2B is a block diagram of an exemplary lock programming menu arrangement for an electromechanical padlock.
Figure 3:
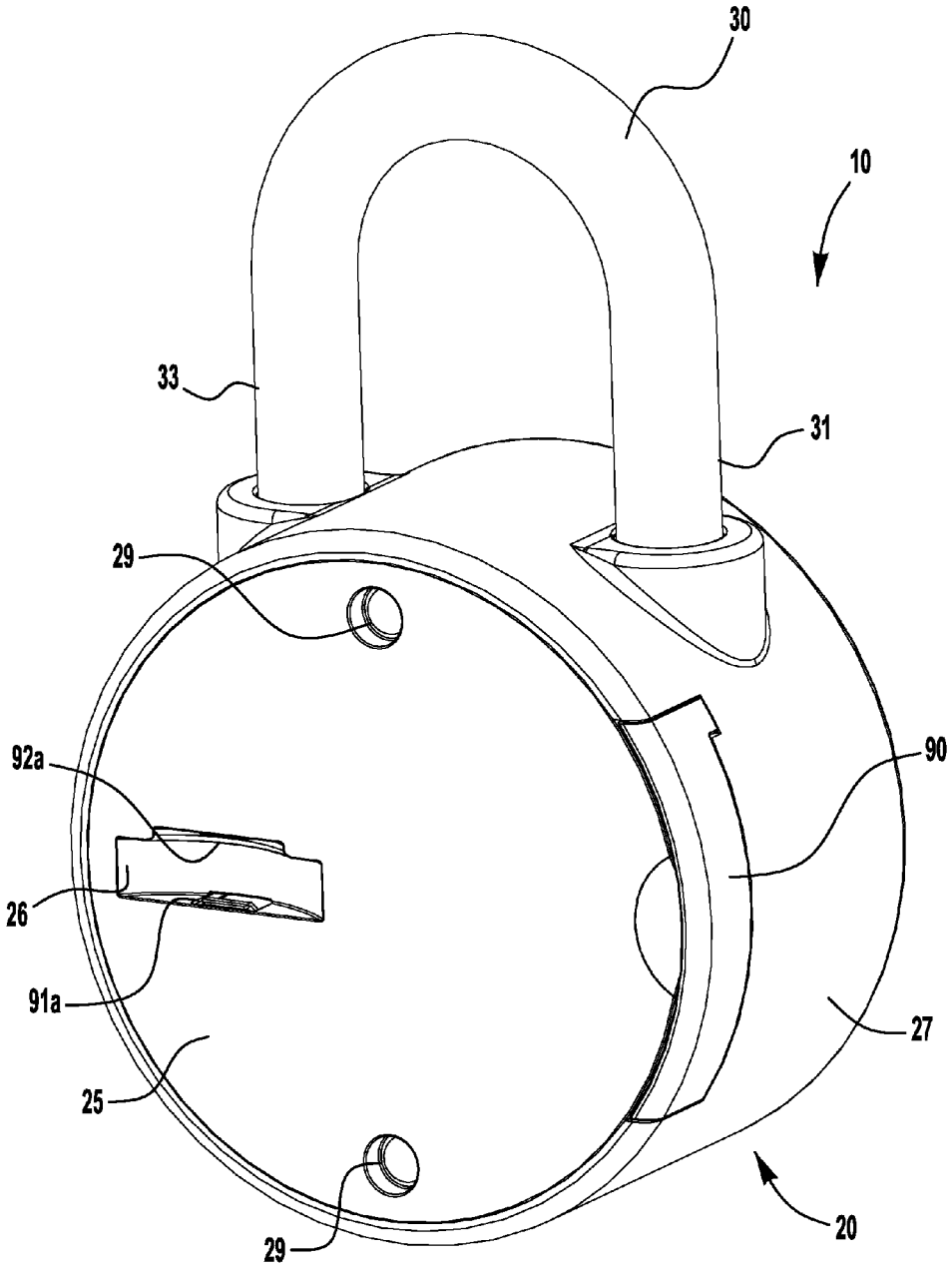
FIG. 3 is a rear perspective view of the padlock of FIG. 2.
Figure 4A:
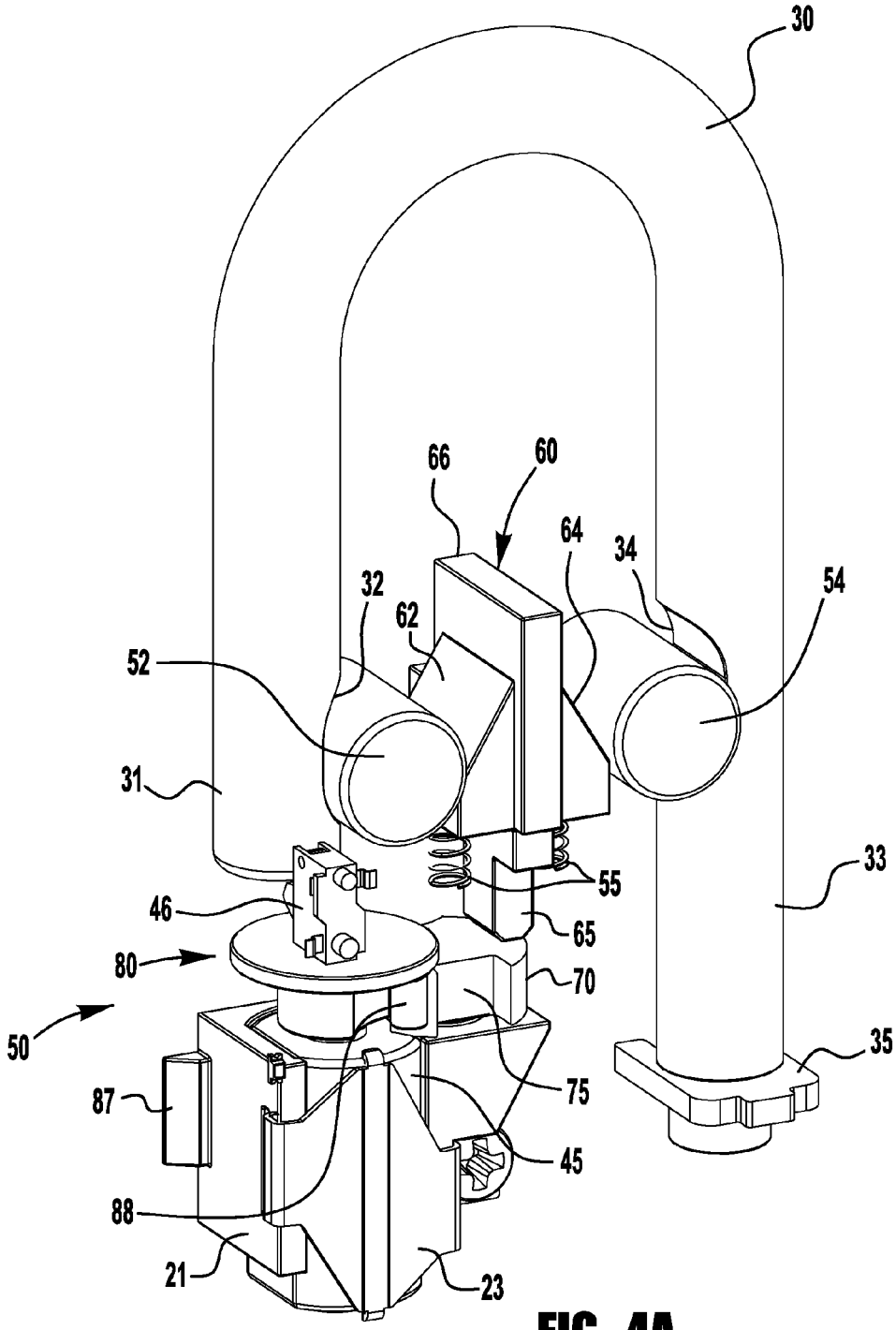
FIG. 4A is a perspective view of the shackle and internal locking mechanism of the padlock of FIG. 2, shown with the latch cam and driver in the locked condition.
Figure 4B:
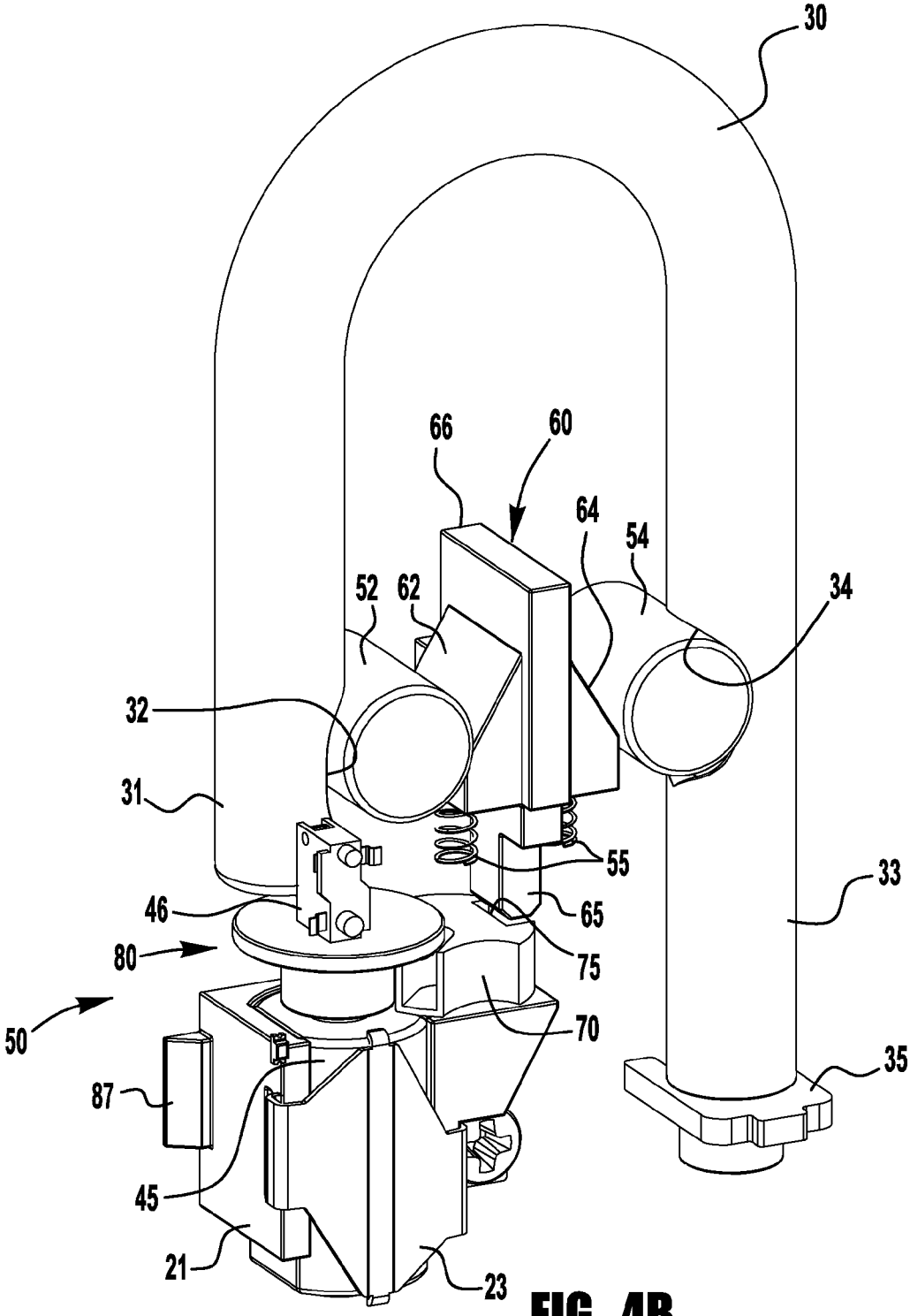
FIG. 4B is a perspective view of the shackle and internal locking mechanism of the padlock of FIG. 2, shown with the latch cam and driver in the unlocked condition.
Figure 4C:
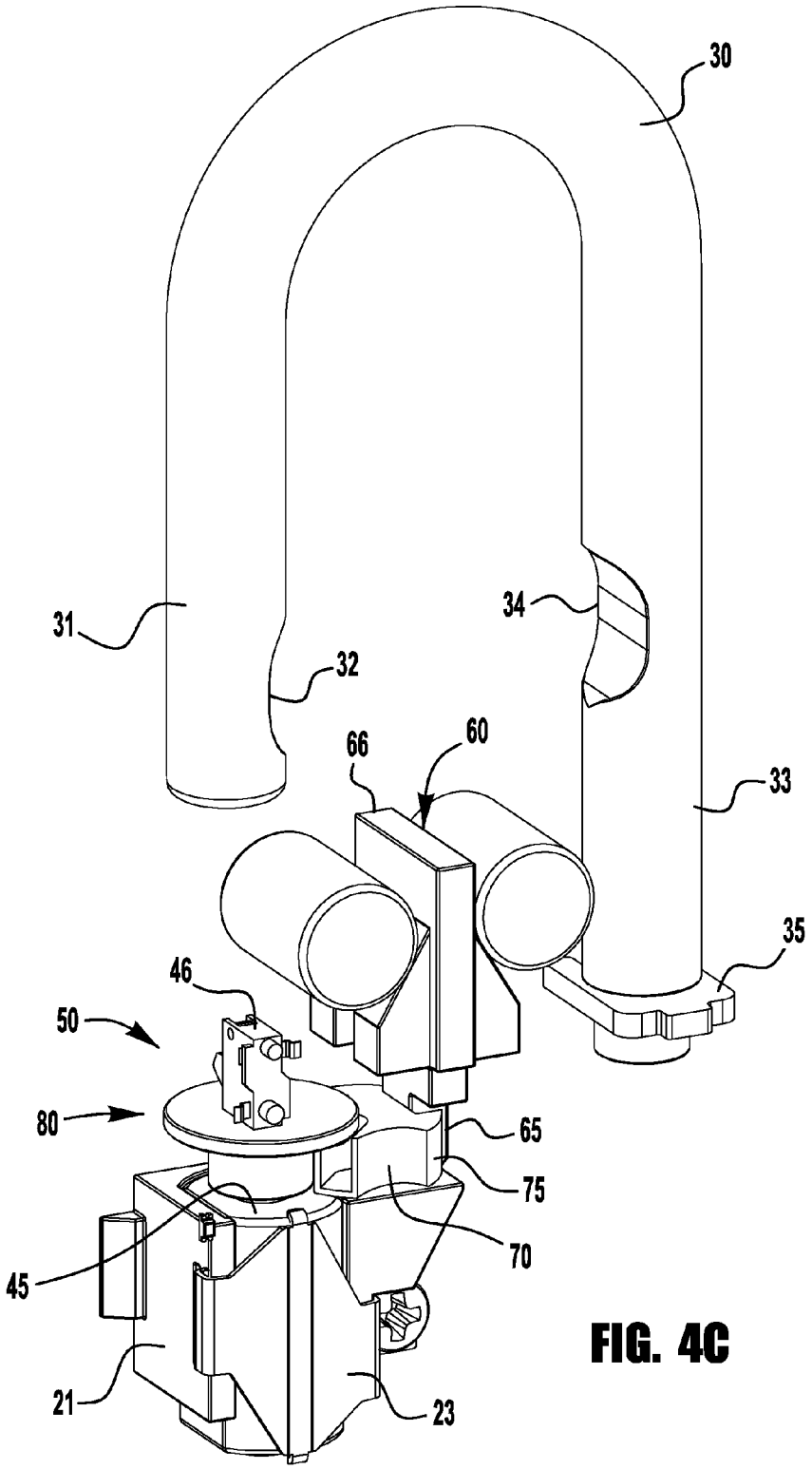
FIG. 4C is a perspective view of the shackle and internal locking mechanism of the padlock of FIG. 2, shown with the latch cam and driver in the unlocked condition and the shackle pulled to the withdrawn condition.

Many different procedures for programming or re-programming the lock may be enabled using keypad buttons and an electronic display. FIG. 2B is a block diagram illustrating an exemplary menu-based arrangement 100 for programming an electromechanical padlock. From a start condition of the lock, at block 110, user entry of a menu access prompt (e.g., initiated by simultaneous or prolonged pressing of one or more of the keypad buttons) causes the lock display to prompt the user, at block 120, for entry of a master passcode (e.g., to restrict ordinary users from altering the settings of the lock). This passcode may be entered using the keypad buttons, with a button entry or depressing of the shackle indicating to the PC board circuitry that the passcode entry is complete. Upon completion of the passcode entry, the entered passcode is compared with the stored master passcode on the PC board. Identification of an entered passcode that does not match the master passcode returns the lock and its display to the start condition, while identification of an entered passcode that matches the master passcode places the lock and its display in a menu entry condition (block 130). Keypad buttons (e.g., left and right directional buttons) may be used to scroll through available menu options (e.g., clear user passcode, add user passcode, change master passcode, set clock), and another keypad button (e.g., up directional button) may be used to select a displayed menu option.

The menu may be provided with a clear user passcode menu item (block 140). When the clear user passcode menu item is selected, a display prompt for the user to be cleared (block 141) is shown. The user may scroll (e.g., using directional buttons) between established user numbers, user names/initials, or other passcode storage positions to select the passcode position (using a corresponding directional button) to be cleared from the stored set of authorized user passcodes. The lock display will then prompt the user for entry of the corresponding passcode to clear or remove (at block 142). In other embodiments, the menu arrangement may exclude user selection (block 141) and immediately prompt for the passcode to clear or remove. An invalid code entry (e.g., too many button pressings) may prompt an error display (block 143) and a return to the passcode entry prompt (block 142). A delay (e.g., 5 seconds) in button pressings may initiate a display prompt to confirm whether the user is done setting the code (block 144). A "no" entry (e.g., down directional button) returns the lock display and setting to the passcode entry prompt (block 142). A "yes" entry (e.g., up directional button) may cause a code re-entry prompt (block 145) to be displayed, for example, to obtain confirmation that the passcode to be removed has been correctly entered. An invalid code re-entry (e.g., second entered code doesn't match first entered code) or a timed-out condition (e.g., 10 second delay) may prompt an error display (block 146) and a return to the starting position (block 110) or, alternatively, to the passcode entry prompt (block 142). A recognized match of the first and second entered passcodes generates a set user passcode confirmation display (block 147), and the lock display returns to the menu entry condition (block 130). The user may then exit the menu (e.g., by using the down directional button or by scrolling to an "exit" option in the menu), or may select another menu option.

The menu may also be provided with an add/set user passcode menu item (block 150). When the set user passcode menu item is selected, a display prompt for the user number (or other passcode storage position) for which a passcode is to be set (block 151) is shown. The user may scroll (e.g., using directional buttons) between established user numbers, user names/initials, or other passcode storage positions to select the corresponding passcode storage position (using a corresponding directional button) to be provided with an authorized user passcode. Once selected, a display prompt for entry of the new user passcode (block 152) is shown. An invalid code entry (e.g., too many button pressings) may prompt an error display (block 153) and a return to the new passcode entry prompt (block 152). A delay (e.g., 5 seconds) in button pressings may initiate a display prompt to confirm whether the user is done setting the code (block 154). A "no" entry (e.g., down directional button) returns the lock display and setting to the new passcode entry prompt (block 152). A "yes" entry (e.g., up directional button) may cause a code re-entry prompt (block 155) to be displayed, for example, to obtain confirmation that the new passcode has been correctly entered. An invalid code re-entry (e.g., second entered code doesn't match first entered code) or a timed-out condition (e.g., 10 second delay) may prompt an error display (block 156) and a return to the starting position (block 110) or, alternatively, to the new passcode entry prompt (block 152). A recognized match of the first and second entered passcodes generates a set user passcode confirmation display (block 157), and the lock display returns to the menu entry condition (block 130).

The menu may also be provided with a change master passcode menu item (block 160). When the change master passcode menu item is selected, a display prompt for the new master passcode (block 161) is shown. An invalid code entry (e.g., too many button pressings) may prompt an error display (block 162) and a return to the new master passcode entry prompt (block 161). A delay (e.g., 5 seconds) in button pressings may initiate a display prompt to confirm whether the user is done setting the master passcode (block 163). A "no" entry (e.g., down directional button) returns the lock display and setting to the new master passcode entry prompt (block 161). A "yes" entry (e.g., up directional button) may cause a code re-entry prompt (block 164) to be displayed, for example, to obtain confirmation that the new passcode has been correctly entered. An invalid code re-entry (e.g., second entered code doesn't match first entered code) or a timed-out condition (e.g., 10 second delay) may prompt an error display (block 165) and a return to the starting position (block 110) or, alternatively, to the new master passcode entry prompt (block 161). A recognized match of the first and second entered passcodes generates a master passcode change confirmation display (block 166), and the lock display returns to the menu entry condition (block 130).

The lock display may perform additional functions. For example, the lock may be provided with a clock (e.g., integral with the PC board), and the lock display may be used to display the current time and/or date, the time and/or date that the lock was last opened, or other clock-related conditions. A clock may also facilitate additional auditing functions for the lock, for example, allowing for identification of dates and times of successful and unsuccessful unlocking attempts, and unlocking by specific users (as identified by user-specific passcodes). The lock menu may be provided with a clock setting menu option (block 170). When the clock set menu item is selected, a display prompt for setting the hour (block 171) is shown, for example, by flashing the hour position on the clock display. The user may adjust the hour setting (e.g., using up/down directional buttons) and select the current hour (e.g., using right directional button). A display prompt for setting the minutes (block 172) is then shown, for example, by flashing the minute position on the clock display. The user may adjust the minute setting (e.g., using up/down directional buttons) and select the current minute (e.g., using right directional button). A display prompt for selecting between AM and PM (block 173) is then shown, for example, by flashing the AM/PM position on the clock display. The user may adjust the AM/PM setting (e.g., using up/down directional buttons) and select the appropriate setting (e.g., using right directional button). A display prompt for selecting the day of the week (block 174) is then shown, for example, by flashing the day position on the clock display. The user may adjust the day setting (e.g., using up/down directional buttons) and select the current day (e.g., using right directional button). Similar steps (not shown) may be added for setting the date (e.g., month, day, and year). Once all the clock settings have been entered, the lock display may provide a confirmation that the clock has been set (block 175), and the lock display may return to the menu entry condition (block 130).

In the illustrated embodiment, as shown in FIGS. 5A-5D, the buttons 41, 42 of the lock are spring biased outward from the lock body 20. The springs 43 are disposed around post portions 41*a*, 42*a* that protrude from the backs of the buttons through holes in a metal plate 44 that seals the PC board 47 within the lock body 20 so unlawful access to the PC board 47 cannot be gained by prying off the buttons 41, 42. The ends of each of the posts 41*a*, 42*a* are secured to carbon pill contacts 49 that line up with a corresponding set of traces on the PC board 47. The springs 43 on the posts 41*a*, 42*a* bias the carbon pills 49 away from the PC board traces to maintain a gap between the posts and the carbon pills in an "un-pushed" state. When a button 41, 42 is depressed, the carbon pill 49 makes contact with the PC board traces and completes the circuit, signaling to the PC board 47 that a particular button was pushed.

The padlock 10 may be powered, for example, by one or more battery cells B (e.g., a standard CR2450 lithium coin battery) stored within the padlock 10 and electrically connected with the motor 45, PC board 47, and LED's 48, and any other power related component associated with the padlock 10. While many different battery storage arrangements may be utilized, in the illustrated embodiment, the lock body is provided with a door 90 (which may, but need not, serve as a compartment for the battery) that is isolated from the locking mechanism by a rear wall 28 of the main housing 27 (FIGS. 9A and 9B) to prevent access to the locking mechanism through the battery compartment 90. The compartment 90 positions the battery B between battery contacts 91, 92 for electrical connection with the PC board 47.

Figure 7:
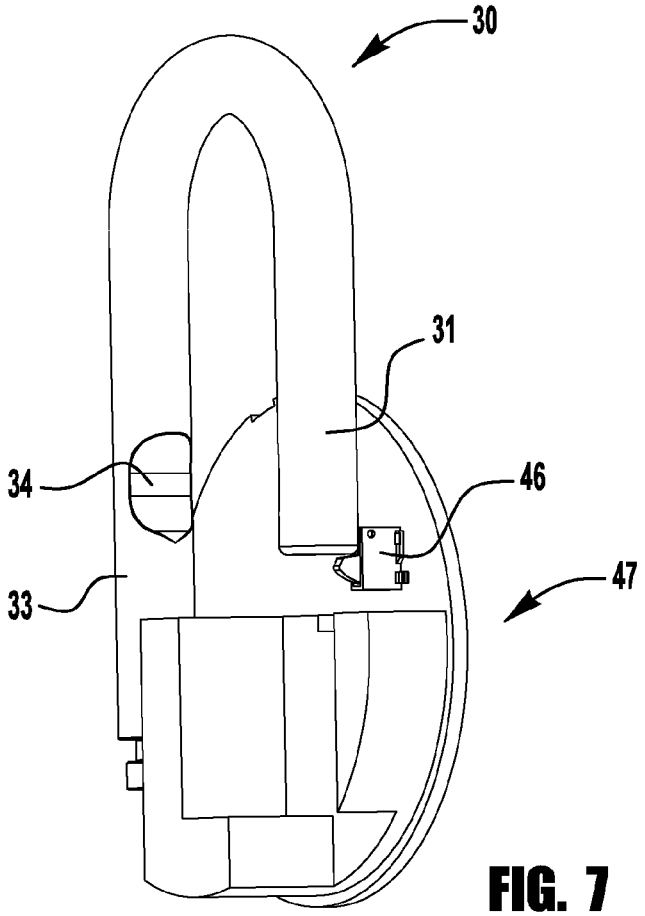
FIG. 7 is a side perspective view of the PC board and shackle of the padlock of FIG. 2.
Figure 8:
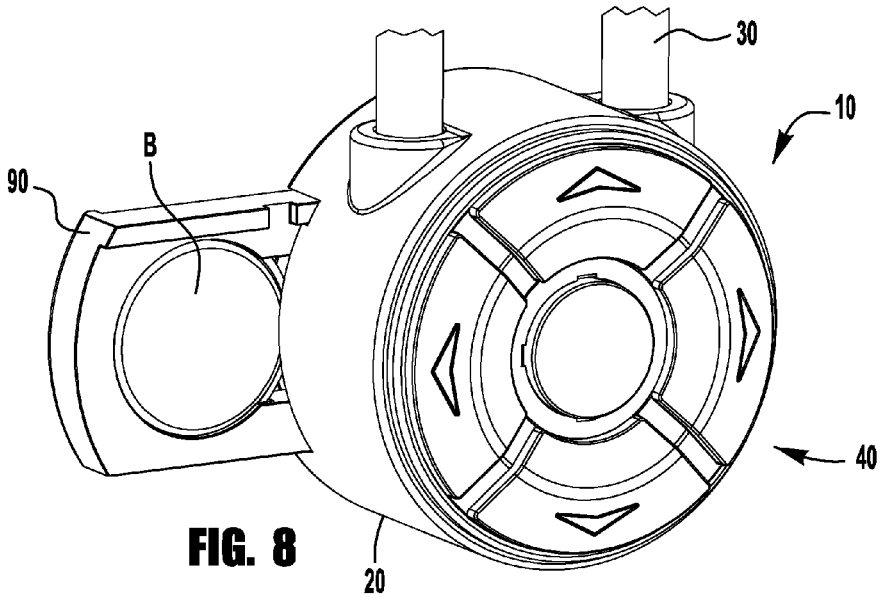
FIG. 8 is a partial front perspective view of the padlock of FIG. 2, shown with the battery compartment in the withdrawn condition.
Figure 9A:
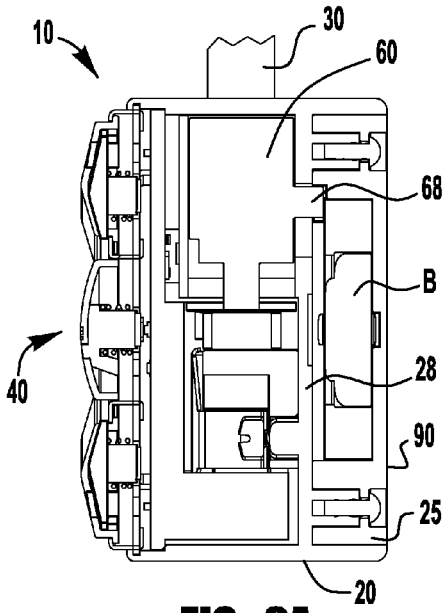
FIG. 9A is a partial side cross-sectional view of the padlock of FIG. 2, shown with the blocker in the locked condition.
Figure 9B:
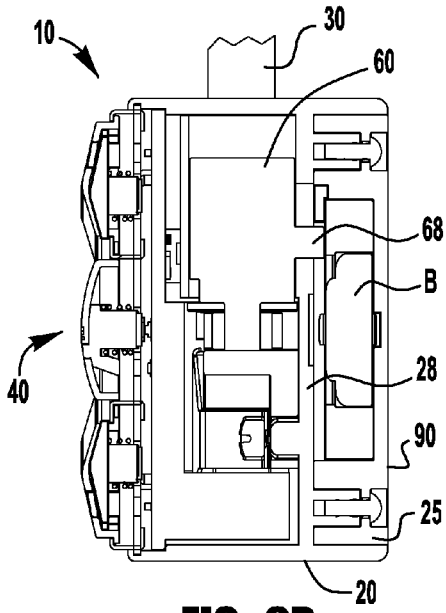
FIG. 9B is a partial side cross-sectional view of the padlock of FIG. 2, shown with the blocker in the unlocked condition.
Figure 10:
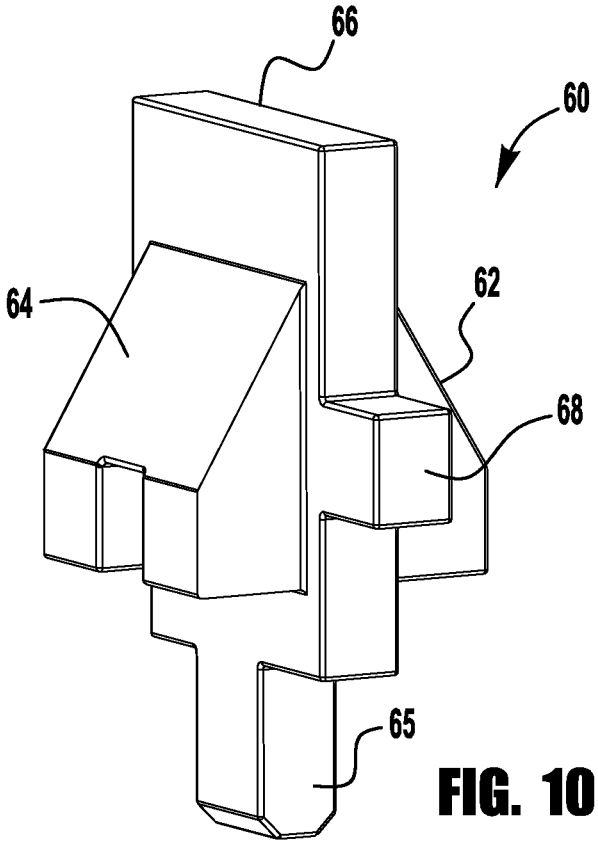
FIG. 10 is a perspective view of the blocker of the padlock of FIG. 2.
Figure 11:
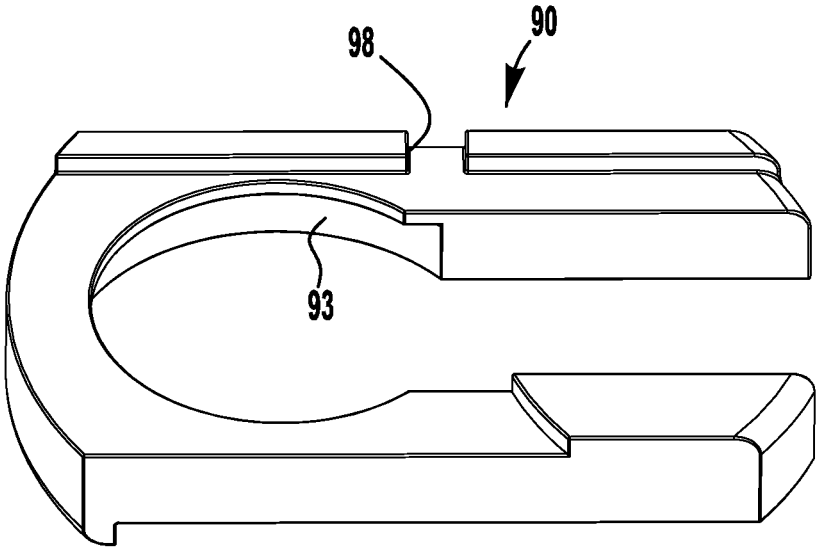
FIG. 11 is a perspective view of the battery compartment of the padlock of FIG. 2.
Figure 12:
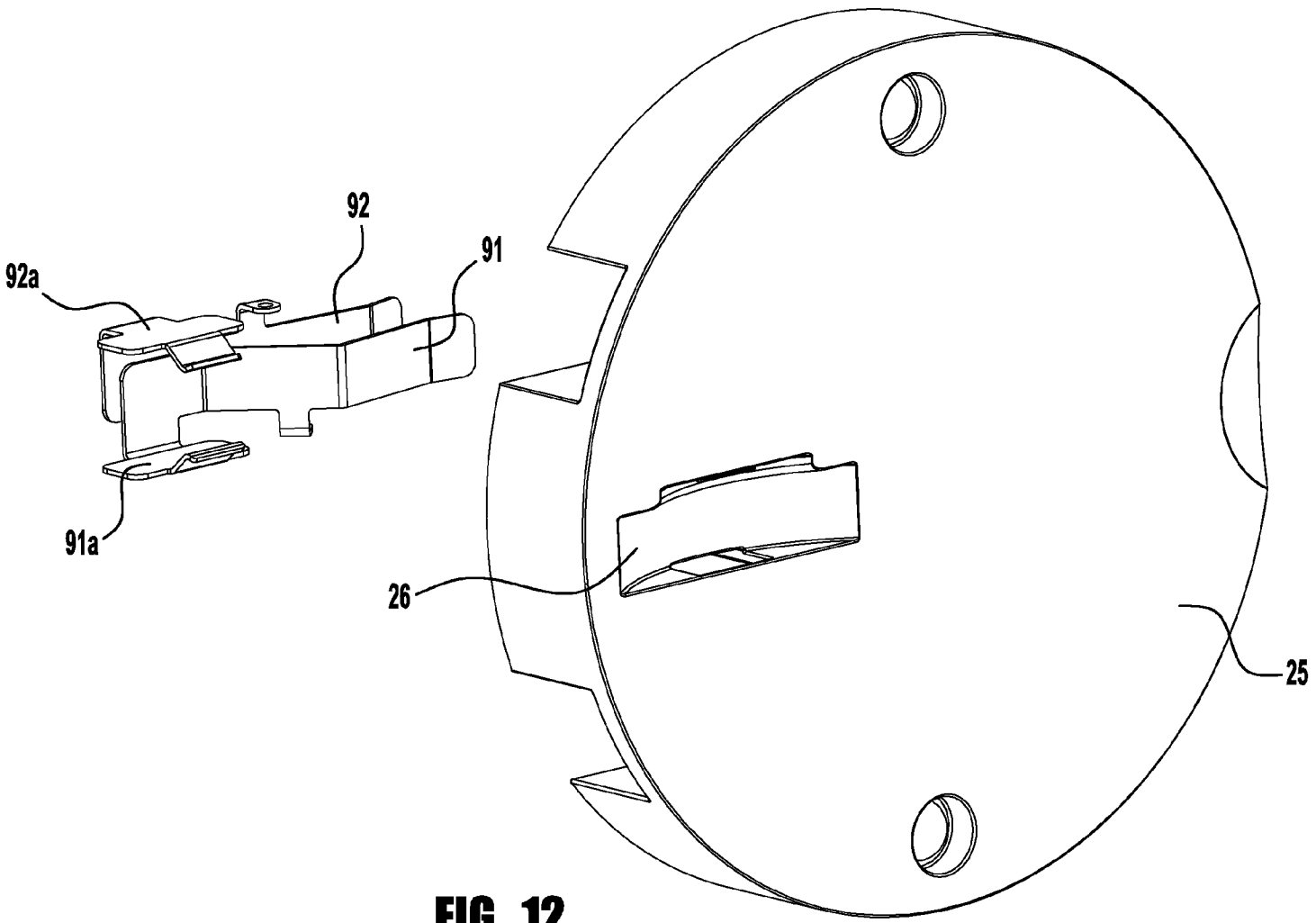
FIG. 12 is a rear exploded perspective view of the back plate and electrical contacts of the padlock of FIG. 2.
Figure 13:
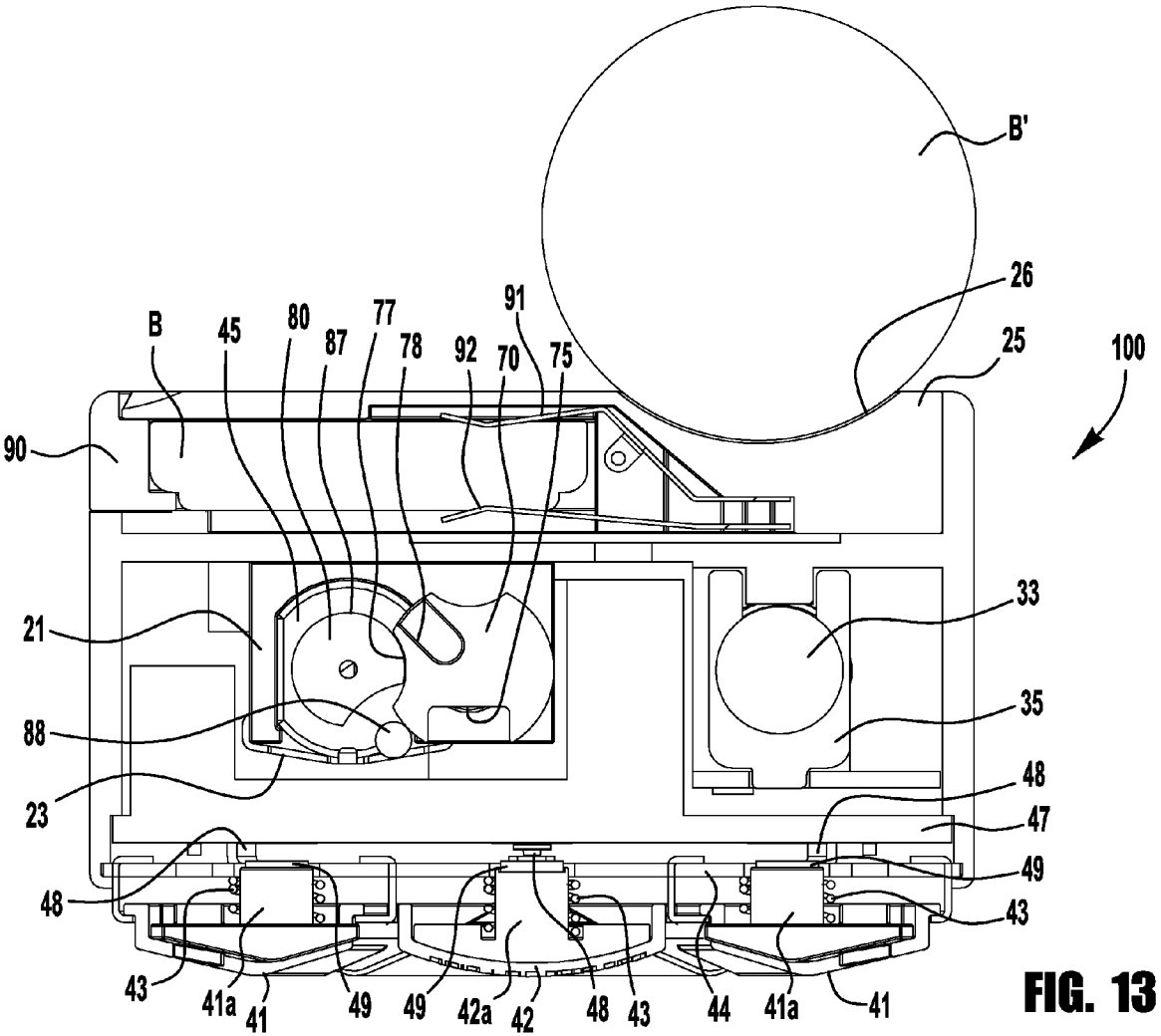
FIG. 13 is an upper cross-sectional view of the padlock of FIG. 2, shown with a spare battery engaged with the padlock to power the padlock.

The exemplary compartment 90 is slidably withdrawable from the lock body 20 for replacement of a depleted battery B, as shown in FIG. 7. The compartment 90 may be provided with a battery receiving recess 93 (FIG. 11) shaped to ensure proper orientation of the installed battery B. To prevent theft or unauthorized removal of a battery B from a locked padlock 10, the blocker 60 may be provided with a projection 68 (see FIG. 10) or other such battery door latch that interlocks with a notch 98 in the compartment 90 when the blocker 60 is in the locked or shackle engaging condition (FIG. 9A), such that sliding movement of the compartment 90 is prevented. When the padlock 10 is unlocked and the blocker 60 is moved to the unlocked condition (FIG. 9B), the projection 68 disengages from the notch 98 in the compartment 90 to allow sliding movement of the compartment 90.

The padlock 10 may further be configured to allow for external power supply to the locking mechanism, for example, in the event of a depleted battery. In the illustrated example, the battery contacts 91, 92 include flange portions 91*a*, 92*a* or other such extensions that extend through the back plate 25 of the lock body 20, for engagement with a spare battery B' (see FIG. 13). As shown in FIGS. 3 and 5A-5D, the back plate 25 of the lock body 20 may be provided with an arcuate recess 26 sized to closely receive the spare battery B' with the battery contact flanges 91*a*, 92*a* positioned to engage the inserted spare battery B'. When the spare battery B' has been inserted and the externally powered padlock 10 has been unlocked, the battery compartment 90 may be withdrawn to replace the depleted battery B with the spare battery B'.

Figure 14A:
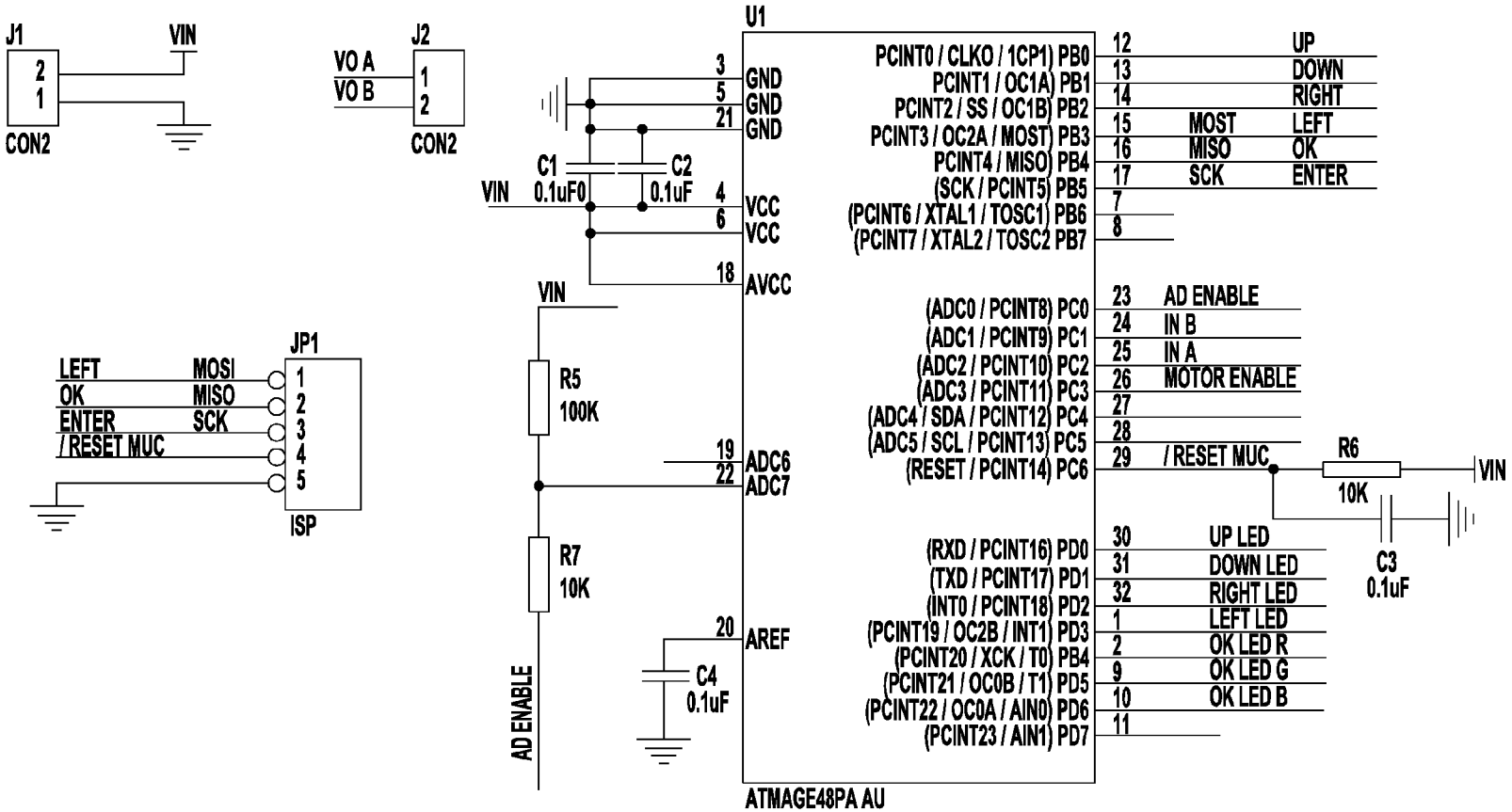
FIGS. 14A-14E are schematic illustrations of the wiring arrangement of the PC board of the padlock of FIG. 2.
Figure 14B:
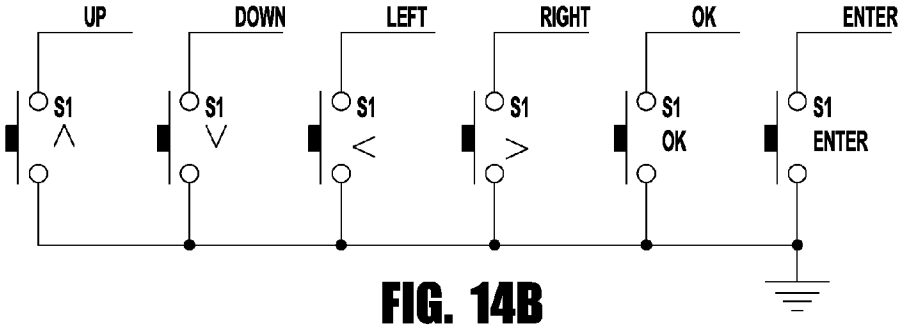
Figure 14C:
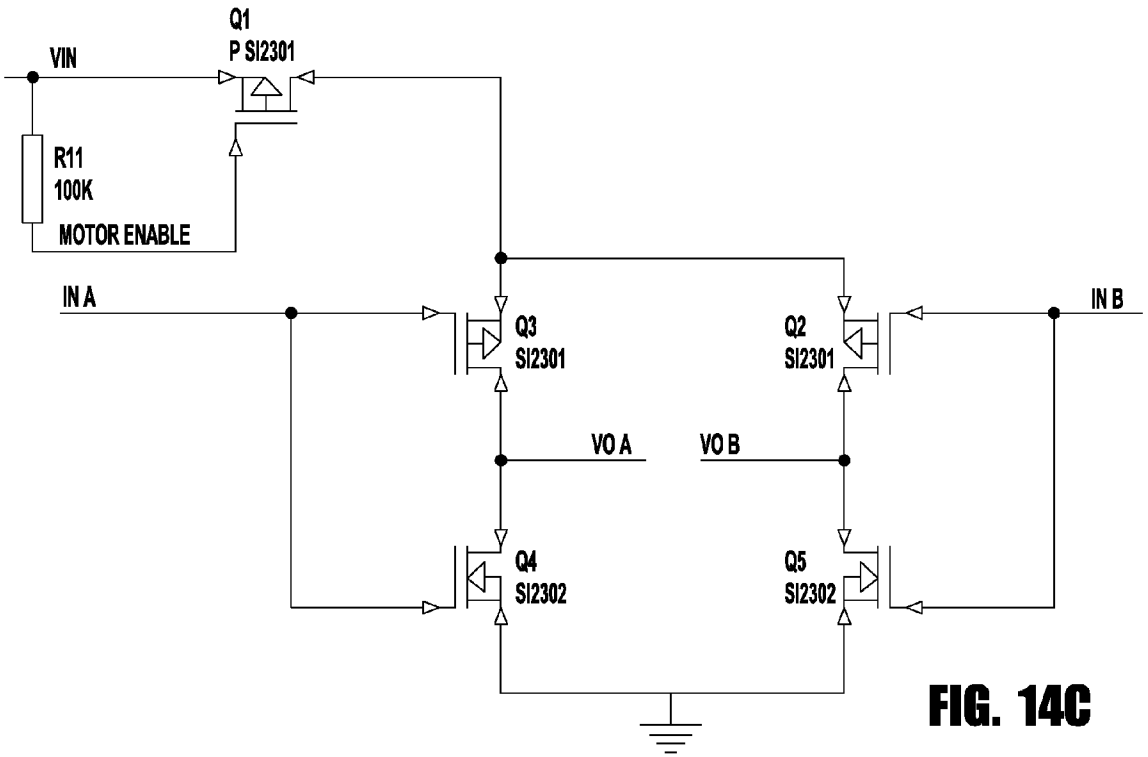
Figure 14D:
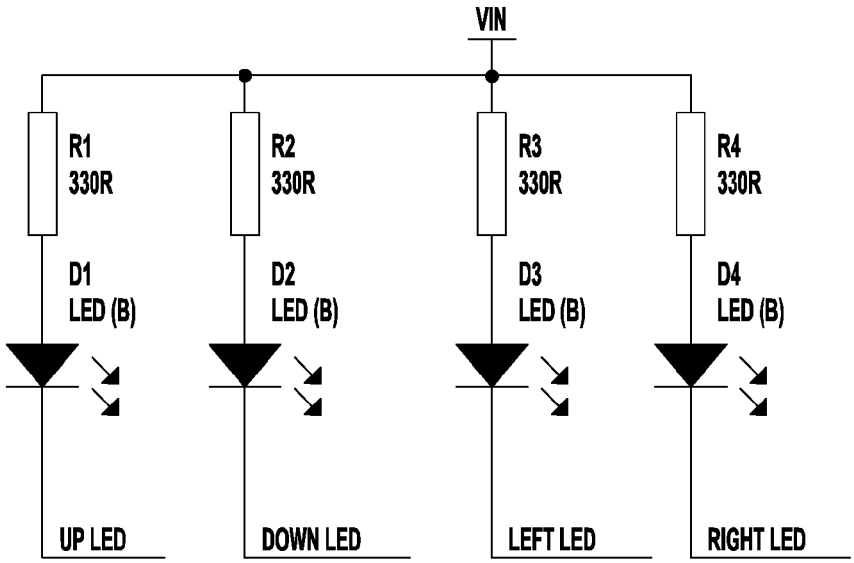
Figure 14E:
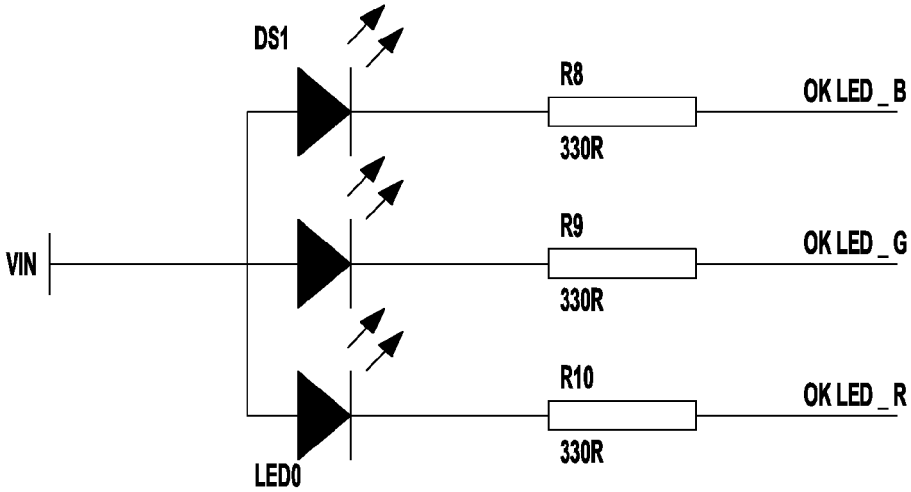

The PC board 47 may be provided with a wide variety of suitable wiring arrangements to allow for secure receipt and evaluation of an entered combination code, signaling of user indicators (e.g., LED's 48), prompting of forward and/or reverse motor operation, and any other suitable electronic or electromechanical functions. Schematic illustrations of exemplary wiring arrangements provided with the exemplary PC board 47 are shown in FIGS. 14A-14E. FIG. 14A schematically illustrates a microcontroller provided with the PC board and configured to scan the five user interface switch buttons and compare an entered button sequence to authorized codes stored in the microcontroller. FIG. 14B schematically illustrates the wiring arrangement of the keypad buttons 41, 42 and shackle switch 46. FIG. 14C schematically illustrates a driver circuit configured to drive the motor 45 (e.g., a bi-directional DC motor). FIGS. 14D and 14E schematically illustrates circuitry for operating LED's associated with the directional buttons 41 and reset button 42, respectively.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

I claim:

1. A padlock comprising:

a lock body, a shackle having long and short legs receivable in corresponding first and second shackle openings in the lock body, the shackle being moveable in an axial direction between a retracted position and an extended position, the short leg being withdrawn from the lock body in the extended position; and a locking mechanism disposed in the lock body, the locking mechanism comprising:

a locking member;

a blacker movable in an axial direction with respect to the lock body and having a blocking surface configured to hold the locking member in locking engagement with the shackle when the blocker is in a shackle engaging position, and further configured to allow the locking member to disengage from the shackle when the blocker is in a shackle disengaging position, to permit movement of the shackle from the retracted position to the extended position;

a latch member movable between a blocker obstructing position obstructing movement of the blocker from the shackle engaging position to the shackle disengaging position and a blocker clearance position permitting movement of the blocker from the shackle engaging position to the shackle disengaging position in response to an axial force applied to the shackle; and a driver operable in response to proper user manipulation of the lock to move the latch member from the blacker obstructing position to the blacker clearance position to permit movement of the blocker to the shackle disengaging position, the driver being inoperable prior to proper user manipulation of the lock.

2. The padlock of claim 1, wherein the latch member comprises a rotatable cam having a cutout that aligns with an end portion of the blocker when the latch member is in the blocker clearance position.

3. The padlock of claim 2, wherein operation of the driver rotates the cam about a first axis that is spaced apart from a central axis of the blocker.

4. The padlock of claim 3, wherein the driver rotates about a second axis that is spaced apart from the first axis.

5. The padlock of claim 2, wherein the driver rotates at least 270° to rotate the cam from the blocker obstructing position to the blocker clearance position.

6. The padlock of claim 1, wherein the driver comprises a rotatable cam.

7. The padlock of claim 6, wherein a portion of the rotatable cam abuts a portion of the latch member to terminate operation of the latch member for movement to the blacker obstructing position and for movement to the blocker clearance position.

8. The padlock of claim 1, wherein the driver comprises a motor.

9. The padlock of claim 8, further comprising an electronic lock interface disposed on the lock body and in electrical communication with the motor.

10. The padlock of claim 9, wherein the electronic lock interface comprises at least one of an electronic keypad, a wireless transceiver, and a biometric sensor.

11. An electromechanical lock comprising:

a lock body; and a locking mechanism disposed in the lock body, the locking mechanism comprising:

a blocker movable between a locked position and an unlocked position;

a first cam rotatable about a first axis between a blocker obstructing position obstructing movement of the blacker from the locked position to the unlocked position and a blocker clearance position permitting subsequent movement of the blocker from the locked position to the unlocked position in response to an axial force applied to the blocker when the first cam is in the blocker clearance position;

a second cam rotatable about a second axis, spaced apart from the first axis, to move the first cam between the blocker obstructing position and the blocker clearance position; and a motor coupled to the second cam to rotate the second cam in response to an electrical authorization signal supplied to the motor.

12. The lock of claim 11, wherein the first cam includes a cutout that aligns with an end portion of the blocker when the first cam is in the blocker clearance position.

13. The lock of claim 11, wherein the second cam rotates at least 270° to rotate the first cam from the blocker obstructing position to the blocker clearance position.

14. The lock of claim 11, further comprising an electronic lock interface disposed on the lock body and in electrical communication with the motor to supply the authorization signal to the motor in response to proper manipulation of the electronic lock interface.

15. The lock of claim 14, wherein the electronic lock interface comprises an electronic keypad.

16. The lock of claim 11, wherein the motor is configured to rotate the first cam from the blocker clearance position to the blocker obstructing position after a predetermined time period from receipt of the authorization signal.

17. The lock of claim 11, wherein a portion of the second cam abuts a portion of the first cam to terminate operation of the first cam for movement to the blocker obstructing position and for movement to the blocker clearance position.

18. An electromechanical padlock comprising:

a lock body;

a shackle having long and short legs receivable in corresponding first and second shackle openings in the lock body, the shackle being moveable in an axial direction between a retracted position and an extended position, the short leg being withdrawn from the lock body in the extended position;

a locking mechanism disposed in the lock body, the locking mechanism comprising:

a locking member;

a blocker movable in an axial direction with respect to the lock body and having a blocking surface configured to hold the locking member in locking engagement with the shackle when the blocker is in a shackle engaging position, and further configured to allow the locking member to disengage from the shackle when the blocker is in a shackle disengaging position, to permit movement of the shackle from the retracted position to the extended position; and an electromechanical driver operable in response to an electrical authorization signal supplied to the electromechanical driver to permit movement of the blocker to the shackle disengaging position in response to an axial force applied to the shackle; and a battery electrically connected with the electromechanical driver to power the electromechanical driver; and a battery door assembled with the lock body to limit access to the battery;

wherein the blocker further comprises a battery door latch configured to secure the battery door in a closed position when the blocker is in the shackle engaging position, and to permit movement of the battery door to an open position when the blocker is in the shackle disengaging position.

19. The padlock of claim 18, further comprising first and second battery contacts for electrically connecting the battery with the electromechanical driver, the first and second battery contacts each including an extension, wherein at least a portion of the first and second battery contact extensions are disposed outside of the lock body for electrical connection of a spare battery to the electromechanical driver.

20. The padlock of claim 18, wherein the battery door latch comprises a projection that extends from the blocker to interlock with a notch in the battery door when the blocker is in the shackle engaging position.

* * * * *

UNITED STATES PATENT AND TRADEMARK OFFICE

CERTIFICATE OF CORRECTION

PATENT NO. : 8,453,481 B2
APPLICATION NO. : 13/183573
DATED : June 4, 2013
INVENTOR(S) : Meekma It is certified that error appears in the above-identified patent and that said Letters Patent is hereby corrected as shown below:

In the Claims

Claim 1, Column 12, line 13, after "a" please remove "blacker" and insert -- blocker --.

Claim 1, Column 12, line 32, before "obstructing" please remove "blacker" and insert -- blocker --.

Claim 1, Column 12, line 32, after "the" please remove "blacker" and insert -- blocker --.

Signed and Sealed this
Twenty-ninth Day of October, 2013

Teresa Stanek Rea

Teresa Stanek Rea
*Deputy Director of the United States Patent and Trademark Office*

UNITED STATES PATENT AND TRADEMARK OFFICE

CERTIFICATE OF CORRECTION

PATENT NO. : 8,453,481 B2
APPLICATION NO. : 13/183573
DATED : June 4, 2013
INVENTOR(S) : Meekma It is certified that error appears in the above-identified patent and that said Letters Patent is hereby corrected as shown below:

In the Claims

Claim 7, Column 12, line 53, after “the” please remove “blacker” and insert -- blocker --.

Claim 11, Column 13, line 5, first word please remove “blacker” and insert -- blocker --.

Signed and Sealed this
Fourteenth Day of October, 2014

Michelle K. Lee

Michelle K. Lee
*Deputy Director of the United States Patent and Trademark Office*